US006772456B2

(12) United States Patent
Votel

(10) Patent No.: US 6,772,456 B2
(45) Date of Patent: Aug. 10, 2004

(54) PORTABLE DEVICE FOR PATIENT PULLUP, ROLLOVER, AND TRANSFER AND METHODS THEREOF

(75) Inventor: Thomas W. Votel, Saint Paul, MN (US)

(73) Assignee: Hill-Rom Services, Inc., Batesville, IN (US)

( * ) Notice: Subject to any disclaimer, the term of this patent is extended or adjusted under 35 U.S.C. 154(b) by 39 days.

(21) Appl. No.: 09/825,768

(22) Filed: Apr. 4, 2001

(65) Prior Publication Data

US 2002/0029418 A1 Mar. 14, 2002

Related U.S. Application Data

(63) Continuation-in-part of application No. 09/307,637, filed on May 7, 1999, now abandoned, which is a continuation-in-part of application No. 09/174,110, filed on Oct. 17, 1998, now Pat. No. 6,341,393, which is a continuation-in-part of application No. 09/057,139, filed on Apr. 8, 1998, now Pat. No. 6,378,148, which is a continuation-in-part of application No. 08/713,412, filed on Sep. 13, 1996, now Pat. No. 5,890,238, which is a continuation-in-part of application No. 08/527,519, filed on Sep. 13, 1995, now Pat. No. 5,737,781, application No. 09/825,768, which is a continuation-in-part of application No. 09/545,538, filed on Apr. 7, 2000.

(60) Provisional application No. 60/204,613, filed on May 16, 2000.

(51) Int. Cl.[7] ..... A61G 7/10

(52) U.S. Cl. ..... 5/81.1 R; 5/81.1 HS; 5/84.1; 5/88.1

(58) Field of Search ..... 5/81.1 R, 83.1, 5/84.1, 86.1, 88.1, 89.1, 81.1 HS, 81.1 C

(56) References Cited

U.S. PATENT DOCUMENTS

| | | | | |
|---|---|---|---|---|
| 378,220 | A | 2/1888 | Staples et al. | 5/81.1 C |
| 716,886 | A | 12/1902 | Goode | 5/88.1 |
| 1,085,879 | A | 2/1914 | Skeffington | 5/88.1 |
| 1,139,526 | A | 5/1915 | Holicky | 294/1.1 |
| 1,263,611 | A | 4/1918 | Scorggin | 5/600 |
| 1,487,171 | A | 3/1924 | Vigne | 5/81.1 C |
| 1,620,298 | A | 3/1927 | Smith | 5/86.1 |
| 1,815,006 | A | 4/1931 | Horsting et al. | 24/498 |

(List continued on next page.)

FOREIGN PATENT DOCUMENTS

| | | |
|---|---|---|
| CH | 660123 A5 | 12/1978 |
| DE | 12 60 692 B | 2/1968 |
| EP | 0875228 A3 | 4/1998 |
| FR | 1 487 854 A | 7/1967 |
| FR | 2687065 | 11/1992 |
| FR | 2 624 007 | 4/1995 |
| GB | 420697 | 12/1934 |
| GB | 1091031 | 11/1967 |
| GB | 1 447 163 | 8/1976 |
| GB | 2 139 487 | 11/1984 |
| WO | WO 86/00221 | 1/1986 |
| WO | WO 95/21600 | 8/1995 |
| WO | WO 97/09896 | 3/1997 |
| WO | WO 97/27770 | 8/1997 |
| WO | WO 98/44889 | 10/1998 |

OTHER PUBLICATIONS

Communication from European Patent Office dated Apr. 8, 2003.

*Primary Examiner*—Robert G. Santos
(74) *Attorney, Agent, or Firm*—Barnes & Thornburg

(57) ABSTRACT

This invention relates to portable devices and their methods of use, which assist in moving patients positioned on beds, gurneys, or other such patient supports. More particularly, the invention relates to portable devices and their methods of use, which enable a single health care worker to perform a patient pullup, roll the patient to a desired position, reposition the patient, or laterally transfer the patient to another patient support.

36 Claims, 23 Drawing Sheets

U.S. PATENT DOCUMENTS

| | | | | | |
|---|---|---|---|---|---|
| 2,093,231 | A | | 9/1937 | Broadwell | 24/464 |
| 2,177,986 | A | | 10/1939 | James | 5/498 |
| 2,291,444 | A | | 7/1942 | Bengtson | 5/498 |
| 2,439,006 | A | | 4/1948 | Vanderlyn et al. | 5/88.1 |
| 2,498,853 | A | | 2/1950 | Hassold et al. | 5/86.1 |
| 2,528,048 | A | | 10/1950 | Gilleland | 5/86.1 |
| 2,536,707 | A | | 1/1951 | Allyn | 5/85.1 |
| 2,565,761 | A | * | 8/1951 | Dean | 5/86.1 |
| 2,630,583 | A | | 3/1953 | Gilleland | 5/81.1 HS |
| 2,632,619 | A | | 3/1953 | Wilson | 248/316.7 |
| 2,665,432 | A | | 1/1954 | Butler | 5/88.1 |
| 2,710,975 | A | | 6/1955 | Stoon et al. | 5/84.1 |
| 2,733,452 | A | | 2/1956 | Tanney | 5/88.1 |
| 2,745,163 | A | | 5/1956 | Vam Buren, Jr. | 24/464 |
| 2,761,153 | A | | 9/1956 | Mew | 5/197 |
| 2,812,524 | A | | 11/1957 | Pruitt | 5/607 |
| 2,826,766 | A | | 3/1958 | Stoner | 5/498 |
| 2,827,642 | A | | 3/1958 | Huff | 5/88.1 |
| 2,860,352 | A | | 11/1958 | Pierre | 5/498 |
| 2,939,195 | A | | 6/1960 | Carlson | 24/459 |
| 2,959,412 | A | | 11/1960 | Sjostrom | 271/84 |
| 2,959,792 | A | | 11/1960 | Haugard | 5/658 |
| 2,979,737 | A | | 4/1961 | Pierre | 5/498 |
| 3,099,842 | A | | 8/1963 | Jensen | 5/84.1 |
| 3,108,290 | A | | 10/1963 | Partridge | 5/88.1 |
| 3,154,340 | A | | 10/1964 | Lowell | 294/104 |
| 3,167,788 | A | | 2/1965 | Murphy et al. | 5/17 |
| 3,167,789 | A | | 2/1965 | Wicks | 5/81.1 HS |
| 3,259,922 | A | | 7/1966 | Fischer | 5/86.1 |
| 3,294,247 | A | | 12/1966 | Norrington | 211/64 |
| 3,302,219 | A | | 2/1967 | Harris | 5/85.1 |
| 3,317,928 | A | | 5/1967 | Root | 4/561.1 |
| 3,363,269 | A | | 1/1968 | Kossuth | 5/83.1 |
| 3,364,506 | A | | 1/1968 | Hale | 5/625 |
| 3,383,717 | A | | 5/1968 | Underwood | 5/612 |
| 3,392,410 | A | | 7/1968 | Grahn | 5/83.1 |
| 3,413,663 | A | | 12/1968 | Swann | 5/613 |
| 3,418,670 | A | | 12/1968 | Morgan | 5/81.1 C |
| 3,451,070 | A | | 6/1969 | Danielson | 5/83.1 |
| 3,452,371 | A | | 7/1969 | Hirsch | 5/87.1 |
| 3,506,985 | A | | 4/1970 | Lang | 5/85.1 |
| 3,506,988 | A | | 4/1970 | Saddoris | 5/411 |
| 3,521,308 | A | | 7/1970 | Fowler et al. | 5/498 |
| 3,562,824 | A | | 2/1971 | White | 5/612 |
| 3,593,351 | A | | 7/1971 | Dove | 5/88.1 |
| 3,597,774 | A | | 8/1971 | Warren | 5/84.1 |
| 3,750,199 | A | | 8/1973 | Spivey | 5/83.1 |
| 3,769,642 | A | | 11/1973 | Warman | 5/81.1 T |
| 3,775,784 | A | | 12/1973 | Fry | 5/81.1 C |
| 3,781,929 | A | | 1/1974 | Stevens | 5/81.1 C |
| 3,794,313 | A | | 2/1974 | Berger et al. | 5/601 |
| 3,810,263 | A | | 5/1974 | Taylor et al. | 5/81.1 C |
| 3,827,089 | A | | 8/1974 | Grow | 5/607 |
| 3,829,914 | A | | 8/1974 | Treat | 5/81.1 T |
| 3,859,677 | A | | 1/1975 | Nordwig | 5/89.1 |
| 3,874,010 | A | | 4/1975 | Geary | 5/610 |
| 3,877,089 | A | | 4/1975 | Spivey et al. | 5/85.1 |
| 3,884,225 | A | | 5/1975 | Witter | 5/630 |
| 3,895,403 | A | | 7/1975 | Davis | 5/81.1 T |
| 3,905,055 | A | | 9/1975 | Blair | 5/85.1 |
| 3,924,281 | A | | 12/1975 | Gibbs | 5/88.1 |
| 3,938,203 | A | | 2/1976 | Linard | 5/81.1 C |
| 4,011,609 | A | | 3/1977 | Bethlen | 5/600 |
| 4,012,799 | A | | 3/1977 | Rutherford | 5/81.1 R |
| 4,038,572 | A | | 7/1977 | Hanagan | 310/46 |
| 4,038,727 | A | | 8/1977 | Robbins | 24/461 |
| 4,051,565 | A | | 10/1977 | Berge | 5/81.1 R |
| 4,070,721 | A | | 1/1978 | Stasko | 5/89.1 |
| 4,077,073 | A | | 3/1978 | Koll et al. | 5/81.1 C |
| 4,092,748 | A | | 6/1978 | Ewers | 5/85.1 |
| 4,125,908 | A | | 11/1978 | Vail et al. | 5/83.1 |
| 4,156,946 | A | | 6/1979 | Attenburrow | 5/81.1 C |
| 4,161,044 | A | | 7/1979 | Bogle | 5/494 |
| 4,180,879 | A | | 1/1980 | Mann | 5/658 |
| 4,194,253 | A | | 3/1980 | Ullven | 5/84.1 |
| 4,195,375 | A | | 4/1980 | Paul | 5/87.1 |
| 4,202,063 | A | | 5/1980 | Murray | 5/87.1 |
| 4,222,132 | A | * | 9/1980 | Crim et al. | 5/81.1 R |
| 4,259,756 | A | * | 4/1981 | Pace | 5/81.1 HS |
| 4,262,375 | A | | 4/1981 | Lilienthal | 5/81.1 HS |
| 4,270,234 | A | | 6/1981 | James | 5/88.1 |
| 4,274,168 | A | | 6/1981 | Depowski | 5/81.1 HS |
| 4,281,564 | A | | 8/1981 | Hill, deceased | 74/665 D |
| 4,296,509 | A | | 10/1981 | Simmons et al. | 5/85.1 |
| 4,327,453 | A | | 5/1982 | Sefton | 5/81.1 C |
| 4,361,918 | A | | 12/1982 | Roisaeth | 5/81.1 T |
| 4,403,641 | A | | 9/1983 | Reeder | 160/263 |
| 4,416,511 | A | | 11/1983 | Weinberg | 359/461 |
| 4,459,712 | A | | 7/1984 | Pathan | 5/81.1 C |
| 4,479,993 | A | | 10/1984 | James | 428/193 |
| 4,490,867 | A | | 1/1985 | Gabrielsson | 5/509.1 |
| 4,498,205 | A | | 2/1985 | Hino | 5/689 |
| 4,500,127 | A | | 2/1985 | Van Derlin | 294/104 |
| 4,502,169 | A | | 3/1985 | Persson | 5/88.1 |
| 4,536,903 | A | | 8/1985 | Parker | 5/81.1 T |
| 4,558,847 | A | | 12/1985 | Coates | 254/9 C |
| 4,627,122 | A | | 12/1986 | Hopp | 5/484 |
| 4,635,308 | A | | 1/1987 | Maggio et al. | 5/658 |
| 4,644,595 | A | | 2/1987 | Daniel | 5/83.1 |
| 4,660,240 | A | | 4/1987 | Hutton et al. | 5/669 |
| 4,662,016 | A | | 5/1987 | Seeman | 5/658 |
| 4,679,259 | A | | 7/1987 | DiMatteo et al. | 5/81.1 C |
| 4,680,818 | A | | 7/1987 | Ooka et al. | 5/81.1 C |
| 4,681,279 | A | | 7/1987 | Nakamura | 242/381 |
| 4,686,748 | A | | 8/1987 | Kaivanto | 24/522 |
| 4,688,304 | A | | 8/1987 | Marcott | 24/459 |
| 4,698,880 | A | | 10/1987 | Hamm | 24/72.5 |
| 4,700,415 | A | | 10/1987 | DiMatteo et al. | 5/88.1 |
| 4,700,417 | A | | 10/1987 | McGovern | 5/81.1 T |
| 4,716,607 | A | | 1/1988 | Johansson | 5/81.1 T |
| 4,726,082 | A | | 2/1988 | DiMatteo et al. | 5/81.1 C |
| 4,739,526 | A | | 4/1988 | Hollick | 5/83.1 |
| 4,747,170 | A | | 5/1988 | Knouse | 5/81.1 HS |
| 4,761,841 | A | | 8/1988 | Larsen | 5/81.1 C |
| 4,776,047 | A | | 10/1988 | DiMatteo | 5/81.1 C |
| 4,782,543 | A | | 11/1988 | Hutton et al. | 5/658 |
| 4,787,104 | A | | 11/1988 | Grantham | 5/613 |
| 4,794,660 | A | | 1/1989 | Hawkrigg | 5/498 |
| 4,796,313 | A | | 1/1989 | DiMatteo et al. | 5/81.1 C |
| 4,809,377 | A | | 3/1989 | Lynn | 5/658 |
| 4,819,283 | A | | 4/1989 | DiMatteo et al. | 5/81.1 C |
| 4,821,352 | A | | 4/1989 | DiMatteo et al. | 5/81.1 C |
| 4,829,617 | A | | 5/1989 | Dameron | 5/658 |
| 4,837,872 | A | | 6/1989 | DiMatteo et al. | 5/88.1 |
| 4,837,873 | A | | 6/1989 | DiMatteo et al. | 5/81.1 C |
| 4,840,363 | A | | 6/1989 | McConnell | 5/624 |
| 4,843,665 | A | | 7/1989 | Cockel et al. | 5/88.1 |
| 4,850,562 | A | | 7/1989 | Mazzanti | 248/316.1 |
| 4,868,938 | A | | 9/1989 | Knouse | 5/88.1 |
| 4,872,226 | A | | 10/1989 | Lonardo | 5/81.1 T |
| 4,887,325 | A | | 12/1989 | Tesch | 5/84.1 |
| 4,908,890 | A | | 3/1990 | Beckman et al. | 5/81.1 R |
| 4,918,771 | A | | 4/1990 | James | 5/87.1 |
| 4,920,590 | A | | 5/1990 | Weiner | 5/86.1 |
| 4,937,901 | A | | 7/1990 | Brennan | 5/607 |
| 4,937,904 | A | | 7/1990 | Ross | 5/497 |
| 4,939,801 | A | | 7/1990 | Schaal et al. | 5/607 |
| 4,941,220 | A | | 7/1990 | DiMatteo et al. | 5/81.1 C |
| 4,970,738 | A | | 11/1990 | Cole | 5/81.1 C |
| 4,987,623 | A | | 1/1991 | Stryker et al. | 5/86.1 |
| 5,001,789 | A | | 3/1991 | Schoenberger | 5/87.1 |

| | | | | | |
|---|---|---|---|---|---|
| 5,014,399 | A | | 5/1991 | Grisel | 24/72.5 |
| 5,014,968 | A | | 5/1991 | Lammers et al. | 5/611 |
| 5,016,306 | A | | 5/1991 | Grivna et al. | 5/498 |
| 5,018,225 | A | | 5/1991 | Fergni et al. | 5/607 |
| 5,022,810 | A | | 6/1991 | Sherrow et al. | 414/501 |
| 5,033,132 | A | | 7/1991 | Greenblatt | 4/608 |
| 5,033,170 | A | | 7/1991 | Ewert | 24/459 |
| 5,036,557 | A | | 8/1991 | Fales | 5/81.1 R |
| 5,038,424 | A | | 8/1991 | Carter et al. | 5/81.1 C |
| 5,046,207 | A | | 9/1991 | Chamberlain | 5/496 |
| 5,048,133 | A | | 9/1991 | Iura et al. | 5/81.1 C |
| 5,050,254 | A | | 9/1991 | Murphy | 5/625 |
| 5,054,140 | A | | 10/1991 | Bingham et al. | 5/600 |
| 5,060,324 | A | | 10/1991 | Marinberg et al. | 5/81.11 |
| 5,063,624 | A | | 11/1991 | Smith et al. | 5/611 |
| 5,065,464 | A | | 11/1991 | Blanchard et al. | 5/81.1 R |
| 5,068,931 | A | | 12/1991 | Smith | 5/84.1 |
| 5,072,840 | A | | 12/1991 | Asakawa et al. | 212/312 |
| 5,083,331 | A | | 1/1992 | Schnelle et al. | 5/600 |
| 5,127,113 | A | | 7/1992 | DeMatteo et al. | 5/81.1 C |
| 5,144,284 | A | | 9/1992 | Hammett | 340/573.1 |
| 5,148,558 | A | | 9/1992 | Dunn | 5/81.11 |
| 5,161,276 | A | | 11/1992 | Hutton et al. | 5/692 |
| 5,163,189 | A | | 11/1992 | DeGray | 5/86.1 |
| 5,168,587 | A | | 12/1992 | Shutes | 5/81.1 T |
| 5,172,442 | A | | 12/1992 | Bartley et al. | 5/611 |
| 5,197,156 | A | | 3/1993 | Stryker et al. | 5/428 |
| 5,210,887 | A | | 5/1993 | Kershaw | 5/86.1 |
| 5,239,713 | A | | 8/1993 | Toivio et al. | 5/87.1 |
| 5,271,110 | A | | 12/1993 | Newman | 5/81.1 R |
| 5,274,862 | A | | 1/1994 | Palmer, Jr. et al. | 5/81.1 R |
| 5,279,010 | A | | 1/1994 | Ferrand et al. | 5/600 |
| 5,280,657 | A | | 1/1994 | Stagg | 5/81.1 R |
| 5,285,556 | A | | 2/1994 | Shorin et al. | 24/487 |
| 5,319,813 | A | | 6/1994 | DiMatteo et al. | 5/81.1 C |
| 5,329,657 | A | | 7/1994 | Bartley et al. | 5/617 |
| 5,340,266 | A | | 8/1994 | Hodgetts | 414/527 |
| 5,343,581 | A | | 9/1994 | Bartley et al. | 5/611 |
| 5,359,739 | A | | 11/1994 | Rains et al. | 5/81.1 R |
| 5,377,391 | A | | 1/1995 | Foster | 24/725 |
| 5,379,468 | A | | 1/1995 | Cassidy et al. | 5/86.1 |
| 5,390,379 | A | | 2/1995 | Palmer, Jr. et al. | 5/8.1 C |
| 5,394,576 | A | | 3/1995 | Soltani et al. | 5/709 |
| 5,404,602 | A | | 4/1995 | Kondo | 5/504.1 |
| 5,406,658 | A | | 4/1995 | Olkkonen et al. | 5/83.1 |
| 5,428,851 | A | | 7/1995 | Shore et al. | 5/87.1 |
| 5,456,655 | A | | 10/1995 | Morris | 601/23 |
| 5,469,588 | A | | 11/1995 | DiMatteo et al. | 5/81.1 C |
| 5,513,406 | A | | 5/1996 | Foster et al. | 5/600 |
| 5,522,100 | A | | 6/1996 | Schilling et al. | 5/86.1 |
| 5,524,304 | A | | 6/1996 | Shutes | 5/81.1 R |
| 5,530,974 | A | | 7/1996 | Rains et al. | 5/81.1 T |
| 5,539,941 | A | | 7/1996 | Fuller | 5/85.1 |
| 5,544,371 | A | | 8/1996 | Fuller | 5/85.1 |
| 5,544,395 | A | | 8/1996 | Rosenvinge | 24/460 |
| 5,560,374 | A | | 10/1996 | Viard | 5/713 |
| 5,561,878 | A | | 10/1996 | Ruehl | 5/621 |
| 5,562,091 | A | | 10/1996 | Foster et al. | 128/200.24 |
| 5,577,279 | A | | 11/1996 | Foster et al. | 5/618 |
| 5,608,929 | A | | 3/1997 | Crane | 5/81.1 R |
| 5,613,252 | A | | 3/1997 | Yu et al. | 5/88.1 |
| 5,615,425 | A | | 4/1997 | Corente | 5/81.1 T |
| 5,615,426 | A | | 4/1997 | Hokett | 5/89.1 |
| 5,630,238 | A | | 5/1997 | Weismiller et al. | 5/600 |
| 5,642,537 | A | | 7/1997 | Johnson | 5/81.1 HS |
| 5,647,079 | A | | 7/1997 | Hakamiun et al. | 5/713 |
| 5,651,149 | A | * | 7/1997 | Garman | 5/81.1 HS |
| 5,653,064 | A | | 8/1997 | Kappers et al. | 52/36.4 |
| 5,659,905 | A | | 8/1997 | Palmer, Jr. et al. | 5/88.1 |
| 5,669,089 | A | | 9/1997 | Dees | 5/419 |
| 5,673,443 | A | | 10/1997 | Marmor | 5/88.1 |
| 5,680,661 | A | | 10/1997 | Foster et al. | 5/618 |
| 5,682,631 | A | | 11/1997 | Weismiller et al. | 5/618 |
| 5,692,272 | A | | 12/1997 | Woods | 24/459 |
| 5,697,109 | A | | 12/1997 | Hodgetts | 5/81.1 R |
| 5,708,997 | A | | 1/1998 | Foster et al. | 5/618 |
| 5,715,548 | A | | 2/1998 | Weismiller et al. | 5/624 |
| 5,732,423 | A | | 3/1998 | Weismiller et al. | 5/425 |
| 5,737,781 | A | * | 4/1998 | Votel | 5/81.1 HS |
| 5,745,937 | A | | 5/1998 | Weismiller et al. | 5/624 |
| 5,790,997 | A | | 8/1998 | Ruehl | 5/618 |
| 5,802,636 | A | | 9/1998 | Corbin et al. | 5/425 |
| 5,802,640 | A | | 9/1998 | Ferrand et al. | 5/617 |
| 5,806,111 | A | | 9/1998 | Heimbrock et al. | 5/86.1 |
| 5,819,339 | A | | 10/1998 | Hodgetts | 5/88.1 |
| 5,850,642 | A | | 12/1998 | Foster | 5/81.1 C |
| 5,890,238 | A | * | 4/1999 | Votel | 5/81.1 HS |
| 5,901,388 | A | | 5/1999 | Cowan | 5/81.1 HS |
| 5,937,456 | A | * | 8/1999 | Norris | 5/88.1 |
| 5,996,144 | A | | 12/1999 | Hodgetts | 5/81.1 R |
| 6,058,533 | A | | 5/2000 | Nelson | 5/610 |
| 6,065,162 | A | | 5/2000 | Behr | 5/81.1 R |
| 6,108,837 | A | | 8/2000 | Knebel, III | 5/504.1 |
| 6,128,796 | A | | 10/2000 | McCormick et al. | 5/626 |
| 6,282,734 | B1 | | 9/2001 | Holberg | 5/81.1 HS |
| 6,289,533 | B1 | | 9/2001 | Hodgetts | 5/81.1 R |
| 6,363,555 | B1 | | 4/2002 | LaRose | 5/600 |
| 6,378,148 | B1 | * | 4/2002 | Votel | 5/81.1 HS |
| D456,751 | S | | 5/2002 | Williams | D12/132 |
| 6,393,636 | B1 | | 5/2002 | Wheeler | 5/81.1 R |
| 6,484,332 | B2 | | 11/2002 | Korver, II et al. | 5/81.1 R |
| 6,496,991 | B1 | * | 12/2002 | Votel | 5/81.1 HS |
| 6,507,963 | B2 | | 1/2003 | Hodgetts | 5/81.1 R |
| 6,526,606 | B2 | | 3/2003 | Friedrich | 5/81.1 R |
| 6,539,569 | B2 | * | 4/2003 | O'Connell | 5/81.1 R |
| 6,560,793 | B2 | | 5/2003 | Walker | 5/81.1 T |
| 6,591,435 | B1 | * | 7/2003 | Hodgetts | 5/88.1 |
| 6,615,423 | B2 | * | 9/2003 | Sverdlik et al. | 5/81.1 C |
| 6,629,323 | B2 | * | 10/2003 | Sverdlik et al. | 5/81.1 C |
| 6,662,388 | B2 | * | 12/2003 | Friel et al. | 5/86.1 |
| 2001/0044957 | A1 | * | 11/2001 | Hodgetts | 5/81.1 R |
| 2001/0047543 | A1 | | 12/2001 | VanSteenburg et al. | 5/81.1 C |
| 2002/0029418 | A1 | * | 3/2002 | Votel | 5/81.1 RP |
| 2002/0083521 | A1 | * | 7/2002 | Sverdlik et al. | 5/81.1 R |
| 2002/0083522 | A1 | * | 7/2002 | Sverdlik et al. | 5/81.1 R |
| 2002/0170110 | A1 | | 11/2002 | Hodgetts | 5/86 |
| 2003/0070226 | A1 | | 4/2003 | Heimbrock | 5/81.1 R |
| 2003/0074732 | A1 | * | 4/2003 | Hanson et al. | 5/81.1 R |
| 2003/0100559 | A1 | * | 5/2003 | Sikorski et al. | 514/242 |
| 2003/0100560 | A1 | * | 5/2003 | LaVoie et al. | 514/248 |

* cited by examiner 30
32
34
36
38
40
41
42
43
44
45
46
47
48
52
54
56

PORTABLE DEVICE FOR PATIENT PULLUP, ROLLOVER, AND TRANSFER AND METHODS THEREOF

CROSS-REFERENCES TO RELATED APPLICATIONS

This application is a continuation in part of U.S. application Ser. No. 09/307,637 filed May 7, 1999 now abandoned, which is a continuation in part of U.S. application Ser. No. 09/174,110 filed Oct. 17, 1998 now U.S. Pat. No. 6,341,393, which is a continuation in part of U.S. application Ser. No. 09/057,139 filed Apr. 8, 1998 now U.S. Pat. No 6,378,148, which is a continuation in part of U.S. application Ser. No. 08/713,412 filed Sep. 13, 1996 now U.S. Pat. No. 5,890,238, which is a continuation in part of U.S. application Ser. No. 08/527,519 now U.S. Pat. No. 5,737,781 filed Sep. 13, 1995. Additionally, this application is a continuation in part of U.S. application Ser. No. 09/545,538 filed Apr. 7, 2000, which is a continuation in part of U.S. application Ser. No. 09/174,110 filed Oct. 17, 1998, which is a continuation in part of U.S. application Ser. No. 09/057,139 filed Apr. 8, 1998, which is a continuation in part of U.S. application Ser. No. 08/713,412 filed Sep. 13, 1996, now U.S. Pat. No. 5,890,238, which is a continuation in part of U.S. application Ser. No. 08/527,519 now U.S. Pat. No. 5,737,781 filed Sep. 13, 1995. Furthermore, this application incorporates by reference the entire contents of the previously mentioned applications and patents and also the entire contents of U.S. Provisional Application No. 60/204,613 filed May 16, 2000.

BACKGROUND OF THE INVENTION

1. Field of the Invention

This invention relates to portable devices and their methods of use, which assist in moving patients positioned on beds, gurneys, or other such patient supports. More particularly, the invention relates to portable devices and their methods of use, which enable a single health care worker to perform a patient pullup, roll the patient to a desired position, reposition the patient, or laterally transfer the patient to another patient support.

2. Background of the Invention

Partially or totally incapacitated persons in hospitals, nursing homes, or other assisted care settings must often be periodically and routinely pulled up from a slumped position, rolled over, or transferred between patient supports such as beds and gurneys. Two or more attendants typically do these maneuvers manually; although the number of attendants required to perform a maneuver increases with the size and weight of the patient.

It is often desirable for patients to lie on platforms in which the head portion of the platform has been raised or angled upwardly. Often, to obtain the most benefit and comfort from a bed in this raised position, the patient should be disposed such that the patient's abdomen and thorax are in an elevated position. However, totally or partially incapacitated patients tend to slide or slump out of this position toward the foot of the bed, thereby losing the healthful benefits of a more upright position.

Another activity frequently required of caregivers is patient rollover. Patient rollover is necessary for maintaining patient comfort, facilitating examination, and preventing bed sores from forming.

A third activity is transporting the patient between patient supports, such as a bed to a gurney or cart, a cart to an operating or procedural table, etc. Generally speaking, this includes maneuvering the patient to another location.

Another activity is that of transporting beds containing bedridden patients. A large patient and a bed can weigh over 400 pounds. The transport of such a weight by pushing can place a severe strain on the attendant as well as creating a control problem. A heavily loaded bed, once in motion, can be difficult to stop.

Typically, space is limited in hospital and assisted care rooms. Therefore, devices to effect patient pullups, rollovers, or transfers must either occupy a minimum amount of space (if kept in the room) or be transported in and out of the room when required. Activities, such as pullups, are typically performed at frequent intervals and it is usually not feasible to transport equipment to and from a room to perform a patient pullup every two hours. However, if such a device used for pullup is to be stored in one of these rooms, the device must occupy a minimum of the limited space available and should be placed so that the pullup will be efficiently accomplished.

U.S. Pat. No. 2,827,642, issued to Huff on Mar. 25, 1958, discloses a device for moving a patient on a bed. The device includes a shaft mounted in ball bearing brackets. The brackets are bolted or otherwise secured to the headposts of the bed. Straps for a fabric webbing are secured to the shaft and a fabric supporting section is secured to the straps. A crank handle is removably secured to one end of the shaft. A patient lying on the fabric supporting section is pulled toward the head of the bed by cranking, and thereby winding the straps on the shaft.

U.S. Pat. No. 5,608,929, issued to Crane on Mar. 11, 1997, discloses a patient-positioning device. The positioning device includes a sheet which is placed under the patient and connected to a rope or braided line. One end of the braided line is anchored to a metal peg on the headboard. The remainder of the braided line is threaded through several pulleys. One of the pulleys is attached to a frame assembly. The patient is pulled up when the head portion of the bed is raised or by an independent motor operating to wind the line. The patient-positioning device of Crane, appears to require extensive retrofitting of beds and is not apparently transportable or suitable for various maneuvers.

U.S. Pat. No. 3,597,774, issued to Warren on Aug. 10, 1971, discloses a patient moving device which is attached to hospital beds. The patient moving device includes an adjustable post and clamps for attaching the post to the head of a bed. A winch is mounted on the post. A patient to be pulled up is secured with apron straps and apron tabs are connected to a T-bar. The T-bar is connected to a cable. The winch is operated to wind the cable and pull the patient up. Alternatively, a harness is employed. The harness is arranged under the patient's arm pits and connected to the T-bar before the winch is operated to pull the patient up.

U.S. Pat. No. 3,302,219, issued to Harris on Feb. 7, 1967, discloses a hospital bed and lifting and turning device. The lifting and turning device includes four vertical support members adjacent the head and foot of the bed. The vertical support members are hollow and threaded to receive the lower end of threaded members extending vertically from the vertical support members. The vertical support members are interconnected by side braces and transverse braces. A sprocket member is disposed atop each vertical member. Each sprocket member is adapted to threadably engage, and thereby raise or lower, a threaded member within the vertical support member. The drive sprockets are interconnected by an endless sprocket chain. An electric motor may be secured to one of the vertical members to drive the sprockets. Upper ends of the threaded members are provided with clamp members. Two elongated rods extend through outwardly extending portions of the clamp members. A sprocket wheel is secured to each elongated rod and separate sprocket drive chains connect sprocket wheel pairs at head and foot portions of the device. A fabric such as canvas is secured to the rods and rolled thereon. The fabric is rolled such that it will be wound on one rod and unwound from the other when the sprocket wheels are rotated. The hospital bed lifting and turning device of Harris appears to require extensive set up, is not readily transportable, and cannot effect a patient pullup or lateral transfer.

U.S. Pat. No. 5,544,371, issued to Fuller on Aug. 13, 1996, discloses a bed patient turning, lifting and transporting apparatus with a mobile, folding and knock-down frame. The apparatus does appear to be conveniently mobile and requires extensive set up before being used. The apparatus of Fuller also requires significant overhead space and could interfere or impede other necessary activities performed by medical personnel in attendance.

U.S. Pat. No. 5,659,905, issued to Palmer et al. on Aug. 26, 1997, discloses a patient transfer/turning bed. The patient transfer/turning bed of Palmer et al. includes powered rotating drive rollers on each side of the bed's mattress. The drive rollers are connected to articulating arms which pivot about an axis near the center of the head end and the foot end of the bed. A transfer/turning sheet removably connects the drive rollers. By raising the drive roller on one side of the bed, a patient will be rolled over toward the opposite side. The patient may also be transferred laterally across the bed by turning the drive rollers. In addition to requiring extensive bed retrofit, the patient transfer/turning bed of Palmer et al., is not readily transportable and cannot effect a patient pullup.

U.S. Pat. No. 2,665,432 issued to Butler on Jan. 12, 1954, discloses a patient transferring device. The patient transferring device of Butler is disclosed as including a roller mounted to a gurney. A pull unit is attached to the roller by a series of hooks and attaches to a transfer sheet. Although capable of effecting a type of lateral patient transfer, the patient transferring device of Butler cannot effect either a patient pullup or patient rollover.

U.S. Pat. No. 2,733,452, issued to Tanney on Feb. 7, 1956, discloses a hospital patient transfer device. The patient transfer device of Tanney is adapted to be mounted on a wheeled stretcher so that a patient may be transferred from a hospital bed to the stretcher or from the stretcher to the bed. The patient transfer device includes one roller mounted on the bed and another roller mounted on the stretcher. A cable is wound on one of the rollers and tracks thereby pulling a sheet from the stretcher while the sheet is guided beneath a patient disposed on the bed. After the patient and sheet are positioned, the sheet is wound on the roller mounted on the stretcher, thereby transferring the patient. The hospital patient transfer device of Tanney appears to require extensive bed and stretcher retrofit and cannot function either to pull a patient up or effect a patient rollover.

U.S. Pat. No. 4,776,047 issued to DiMatteo on Oct. 11, 1988, discloses a multiple function invalid bed arrangement for transferring a prone patient longitudinally or laterally between beds or surfaces adapted to accept the patient in a prone position. The longitudinal bed transfer is accomplished by equipping the patient's bed with two rollers, one roller at the head and one roller at the foot of the bed. A bed sheet is connected from the head to the foot roller much like a piano roll. The rollers are rotated to transfer the patient to a second bed which is equipped similarly. Thus, the multiple function invalid bed arrangement of DiMatteo appears to require extensive bed retrofit and cannot effect patient maneuvering without such retrofitting.

U.S. Pat. No. 4,868,938 issued to Knouse on Sep. 16, 1989, discloses a transportable patient mover and moving method. The patient mover moves a patient laterally from a first to a second surface such as from a bed to a gurney. The patient mover includes a bottom stand member and an upstanding support frame carrying an elongated roller. The support frame may be mounted on wheels or casters. One edge of a web-like sheet material is attached to the roller. The other edge of the web material is attached to a clamp. A transfer sheet disposed beneath a patient is secured by the clamp and the roller winds the web thereon, thereby transferring the sheet and patient thereon. The patient mover of Knouse does not appear suitable for remaining in a small hospital room between uses without interfering with essential activities.

There is a need for a portable device, which can enable a single attendant to effect patient pullups, rollovers, and lateral transfers, which is readily transportable, and which may be conveniently stored in a patient's room between uses. Further there is a need for a device that will allow a single attendant to relocate beds containing bedridden patients without transferring them out of the bed.

SUMMARY OF THE INVENTION

This invention meets the needs of the industry by providing a portable device for maneuvering a patient who is located on a support platform. The support platform may be configurable to a generally horizontal position or otherwise. A pliable underlayment designed for use with the portable patient transfer device may be disposed between the patient and the support. The device is operable by a single person or operator and may include a housing, a motor winch assembly at least partially disposed within said housing, one or more strap and hook assemblies comprising transfer straps and transfer hooks and at least one mating assembly. Furthermore, some embodiments of the invention are capable of transporting a patient on a patient support under the control of an attendant.

The strap and hook assemblies may be windably attachable to the motor winch assembly and comprises transfer straps operably connected to the transfer hooks. The mating assembly may be in electrical communication with the motor winch assembly and/or may include a mechanism for stabilizing the device. The stabilizing mechanism may be actuated by contacting a first member of the patient support and may also be in electrical communication with an internal or external power source. It is noted that the power source may be internal to the patient support thereby providing power to the transfer device when plugged into the patient support. The stabilizing mechanism may also include a locking mechanism accommodated by the support.

The strap and hook assemblies may include at least one strap and at least one hook. Generally, each strap may be attachable to the motor winch assembly and to one or more of the hooks. The device may further include a first base member and an optional second base member. The second base member may be locked into an extended position to further stabilize the device.

This invention also provides a method of displacing a patient. The method includes providing a device with a housing, a motor winch assembly at least partially disposed within said housing, transfer straps windably adjoined to the motor winch assembly, transfer hooks secured to the straps, and at least one mating assembly. The strap and hook assembly may be attachable to the motor winch assembly. The mating assembly may be in electrical communication with the power train and/or may include means for stabilizing the device. Next, the method includes stabilizing the device by contacting a first member of the support to the stabilizing means. The stabilizing mechanism may be actuated by contact with a first member of the support and may be placed in electrical communication with a power source when contacted with the first member of the support. Once the device is stabilized and powered, the method generally includes securing a pliable underlayment, proximate to the patient, to the strap and hook assembly. The securing of the underlayment prepares the operator to activate the device and transfer or reposition the patient by allowing the device to pull the underlayment and patient to a desired position.

The present invention encompasses several different embodiments. A first embodiment includes a modular, portable patient relocation device. The modular, portable patent relocation device includes engagement members adapted to be engaged to a patient support such as a hospital bed, gurney, cart or any other patient support. Another embodiment of the invention is particularly adapted to engage the headboard, side rails and/or footboard of a hospital bed and may include connectors to draw power from the hospital bed power supply. Yet another embodiment of the invention is configured to replace the existing hospital bed headboard, side rails and/or footboard and may be configured to draw its power supply directly from the hospital bed. A further embodiment of the invention is configured to be temporarily or permanently secured to a hospital bed frame with the pulling members routed via a series of pulleys to allow pulling from the vicinity of the hospital bed headboard, side rails and/or footboard. Yet another embodiment of the invention may further include a drive train connectable to the wheels of the hospital bed to allow for power transport of the hospital be as a whole. Yet another embodiment of the invention may include retractable upright members whereby the pulling members may be directed over the sides of the hospital bed for use in rolling over hospital patients.

A further embodiment of the invention includes a stabilizing base and rolling assembling by which the patient relocation unit may be transported on wheels making it unnecessary to carry the invention. In a variant on this embodiment of the invention, the wheel base and column may include connections to engage the electrical supply of a hospital bed to power the patient relocation unit. The column in a further embodiment of the invention may include the ability to adjust the height of the patient transfer device. The rolling transfer device may also include a clamping device for mechanically engaging the base of a hospital bed to improve stability or to allow the patient relocation device to be used as a tug to provide power to relocate the entire hospital bed along with patient.

A final embodiment of the invention may include a clamping device for engaging the base of a hospital bed that also lifts the hospital bed from the ground to allow transportation to a remote location.

DETAILED DESCRIPTION OF THE PREFERRED EMBODIMENTS

Figures 1, 2:
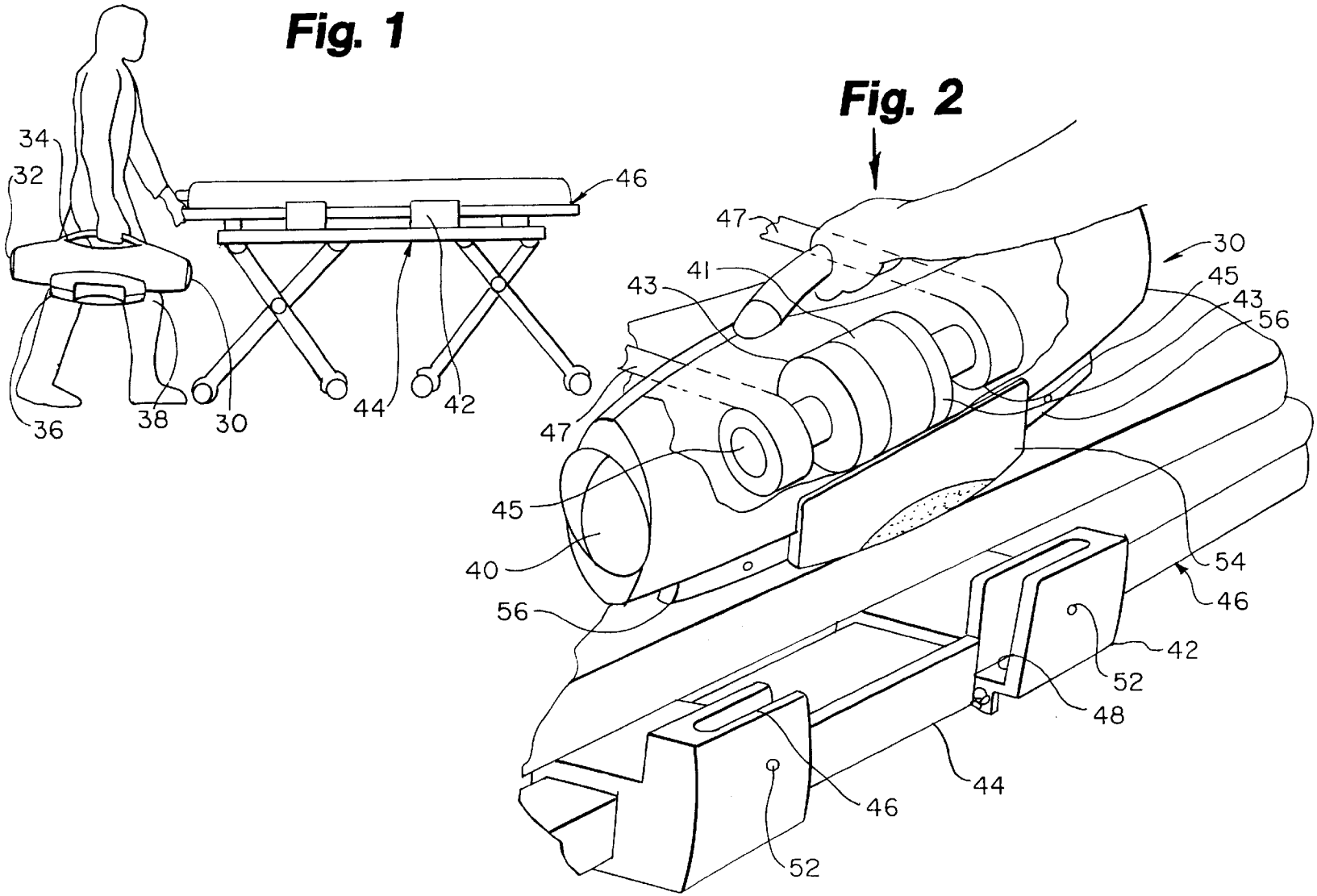
FIG. 1 is an elevational view of the first embodiment of the portable patient transfer device as transported by an operator along with a patient support.
FIG. 2 is a perspective view of the portable patient transfer device of the present invention.

FIGS. 1 and 2 depict a first embodiment of a patient transfer device 30. Patient transfer device 30 generally includes housing 32, handle 34 and a mating assembly 35. In FIGS. 1 and 2 the mating assembly 35 includes a first mating member 36 and second mating member 38. However, the mating assembly 35 may comprise any number of mating members that would operably adjoin the patient transfer device to a patient support. Housing 32 encloses motor winch assembly 40. Generally, the motor winch assembly 40 is operably connected to one or more hook and strap assemblies (not shown) that may be adjoined to a pliable transfer sheet (not shown), which functions to transfer or reposition a patient. It is noted that a description of the hook and strap assemblies and the transfer sheet will be described later in this disclosure.

In various embodiments of the present invention, a motor winch assembly 40 includes a motor 41, one or more reduction drive 43, one or more drums 45 and one or more strap and hook assemblies 47. The motor 41 is preferably an electric motor but may include hydraulic or pneumatic motors. Reduction drives 43 are operably connected to the motor 41 and preferably reduce the motor speed sufficiently to allow for a patient transfer to be accomplished within a short period of time, i.e. twenty to thirty seconds. The drums 45 are operably connected to the reduction drives 43 and are adapted to windably receive the strap and hook assemblies 47. The strap and hook assemblies 47 preferably include high strength synthetic webbing similar to that used in automobile seat belts but, may also include cables, cords or any other elongate material of appropriate strength and flexibility. The clamping portion (not shown) may be any type of connector that may be readily and securely releasably-attached to a pliable transfer sheet as describe later in this disclosure. Furthermore, suitable motor winch assemblies 40, as well as retracting and transfer devices, such as strap and hook assemblies and pliable transfer sheets or drawsheets, for transferring and repositioning a patient, are disclosed in U.S. Pat. Nos. 5,737,781; 5,890,238; and U.S. patent application Ser. Nos. 09/057,139 and 09/307,637 which are hereby incorporated in their entirety by reference.

Patient transfer device 30 may be used in combination with a bracket 42 and a platform 44, which are secured to a patient support 46. The patient support 46 may comprise a hospital bed, gurney, operating table, or any other platform upon which a patient may be supported in a hospital or nursing home setting. The bracket 42 further includes first slot 48 and second slot 50. First slot 48 and second slot 50 may further include securing devices 52. Securing devices 52 are configured to engage to first mating member 36 and second mating member 38 to securely hold patient transfer device 30 to bracket 42. Securing devices 52 may include pins, latches, clamps, or any other mechanism or device by which first and second mating members 36, 38 may be securely, removably held in first slot 48 and second slot 50. It is noted that the bracket 42 may comprise other configurations that can adequately accommodate and secure the patient transfer device to the patient support 46.

Patient transfer device 30 further includes power supply 54. Power supply 54 may be self-contained in the form of an internal power pack, such as batteries, or may be drawn from an outside source by a simple power cord operably attached to an electrical outlet, or by one or more power connection ports 56 incorporated into the mating assembly 35. The incorporation of one or more power connection ports 56 to the mating assembly 35 may allow for the patient transfer device 30 to be powered by a power supply operating through the patient support 42.

Figure 3:
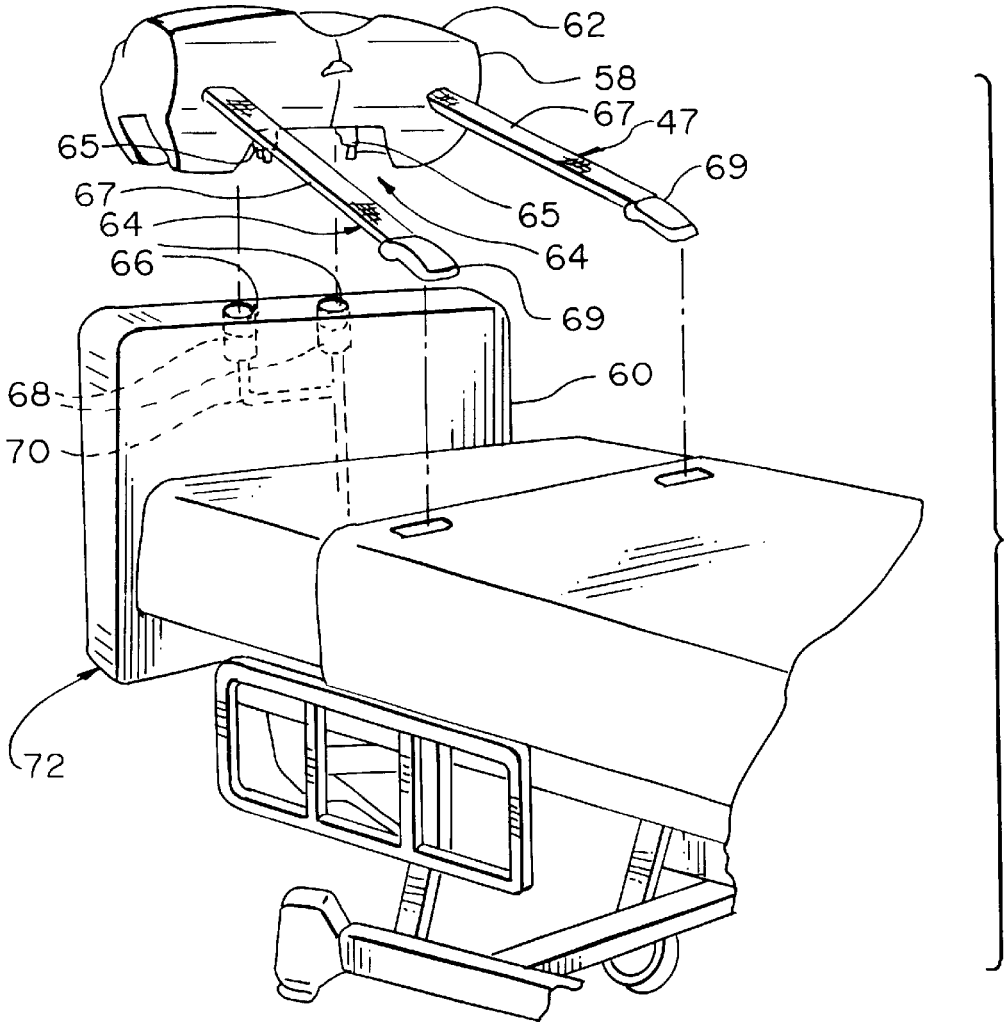
FIG. 3 depicts a second embodiment of a portable patient transfer device.
Figure 4:
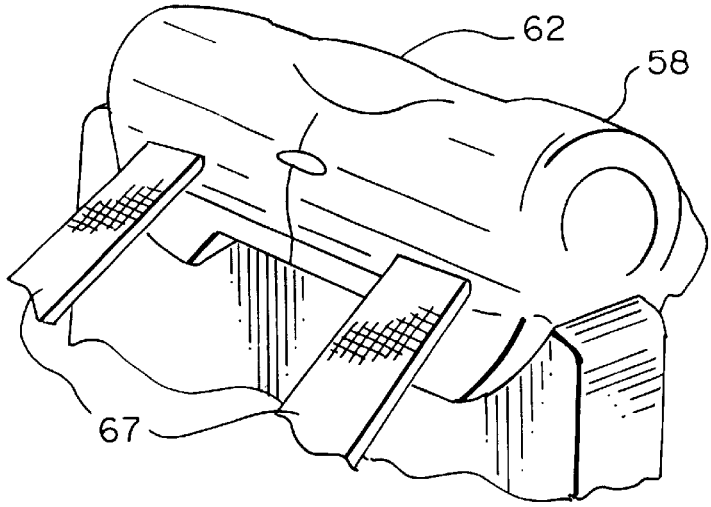
FIG. 4 is an additional perspective view of the second embodiment of the portable patient transfer device.

FIGS. 3 and 4 depict a second embodiment of the patient transfer device 58. Patient transfer device 58 is adapted to be secured to bed headboard 60. Patient transfer device 58 generally includes housing 62, mating assembly 64, and motor winch assembly 40 as previously described. In this embodiment, the motor winch assembly 40 is operably connected to one or more strap and hook assemblies 47. In many of the embodiments the strap and hook assemblies 47 include a strap 67 operably attached to one or more clamping devices 69.

In the embodiments depicted in FIGS. 3 and 4, the mating assembly 64 includes one or more mating members 65 that may be operably adjoined to the headboard 60. The headboard 60 is robustly constructed to support the weight of patients being transported. Also, the headboard 60 generally includes one or more mating ports 66 and one or more power connection port 68 that are both configured for receiving the mating members 65. It is noted that the mating ports 66 and power connection port 68 may be consolidated. Additionally, the motor winch assembly 40 may draw its power supply through the one or more power connection ports 68. Power connection port 68 may draw power from an existing electrical supply 70 present within or operably connected to the patient support 72.

Figure 5:
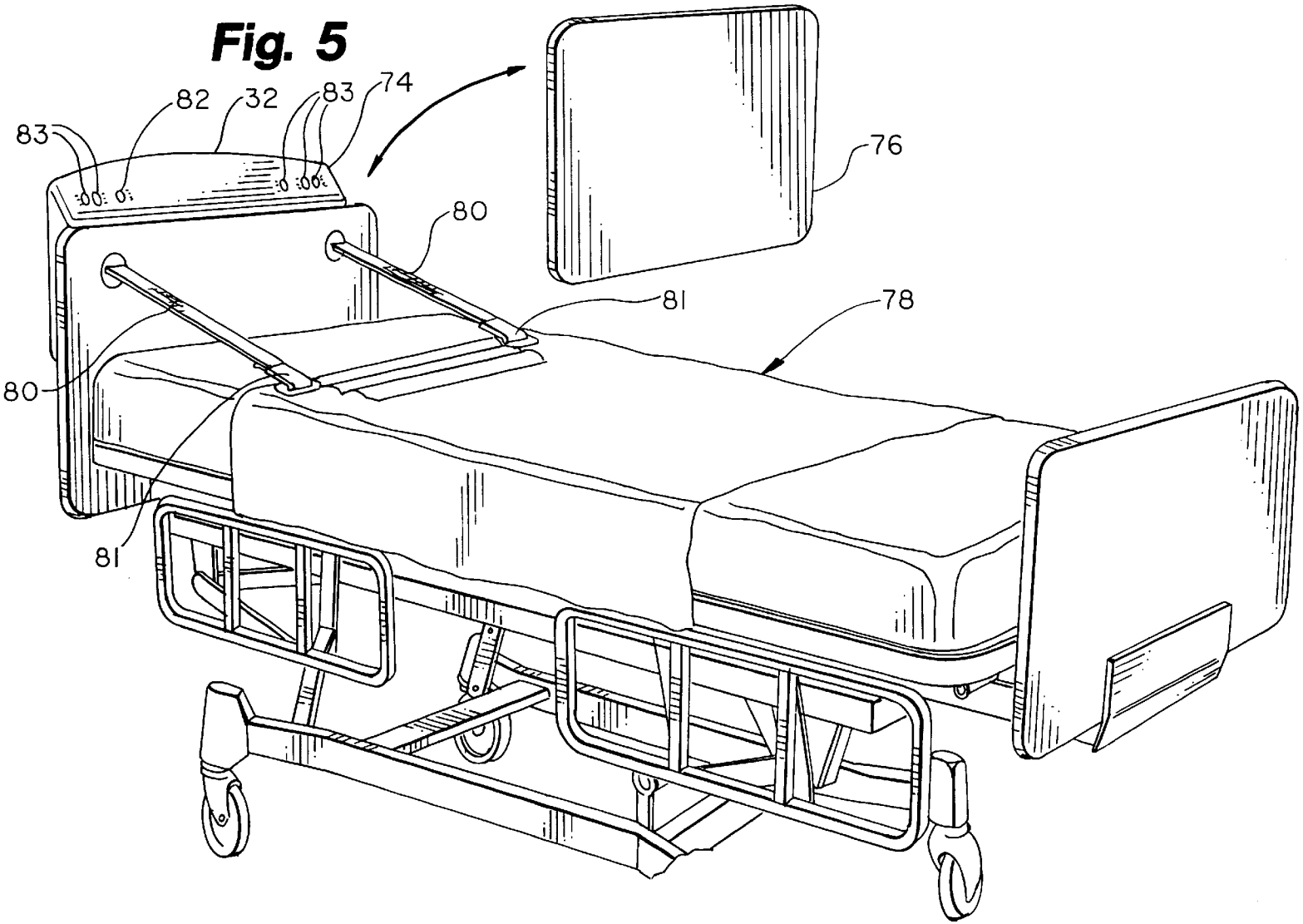
FIG. 5 depicts another embodiment of the patient transfer device adapted for replacing an existing hospital bed headboard.

FIG. 5 depicts another embodiment of the present invention of the patient transfer device 30, wherein the patient transfer device 30 is a retrofitted modular headboard 74. The retrofitted modular headboard 74 is configured to replace the headboard 76 of a conventional hospital bed 78. The modular headboard 74 includes housing 32, motor winch assembly (not shown), transfer straps 80, transfer clamps 81 such as hooks, and a control panel 82. The motor winch assembly, transfer straps 80, transfer clamps 81 and control panel 82 are similar in all embodiments of the invention herein disclosed. The control panel 82 may include automated touch sensitive activators 83, such as buttons or knobs that perform various functions upon activation, such as release or retraction actions.

Figure 6A:
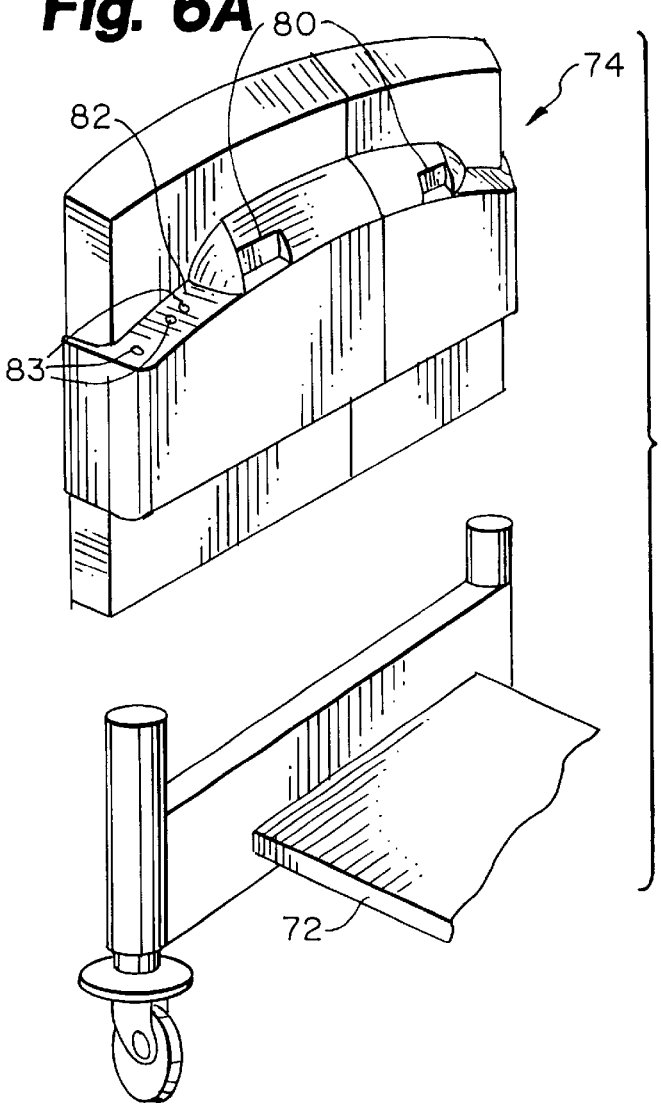
FIG. 6 is a perspective view of another embodiment of the patient transfer device.
Figure 7:
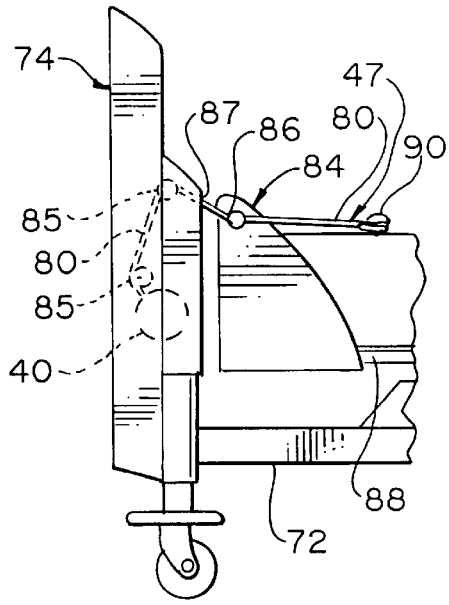
FIG. 7 is a side-elevational view of the patient transfer device of the present invention.
Figure 8:
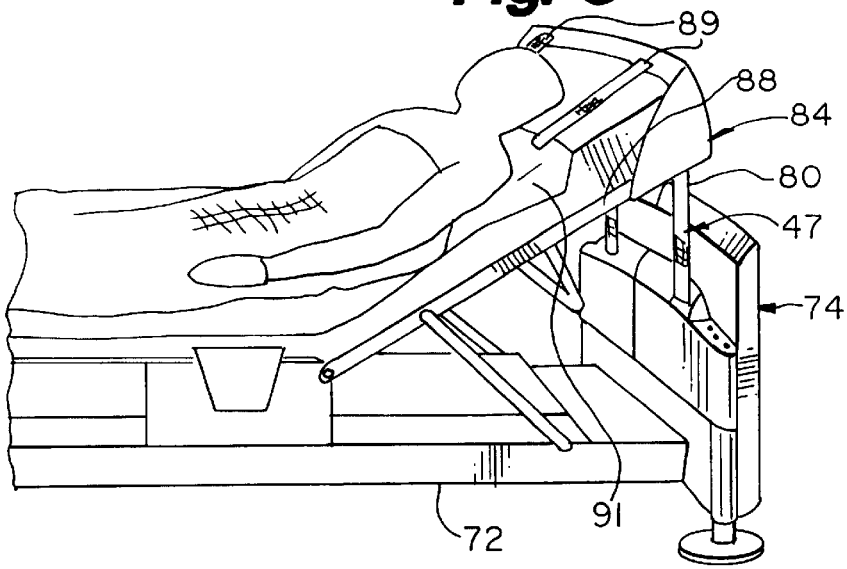
FIG. 8 is a perspective view of the patient transfer device of the present invention further depicting a shroud.

FIGS. 6–8 depict an additional embodiment of the retrofitted modular transfer device 74. One embodiment of the modular transfer device depicted in FIGS. 6–8 includes a housing 32, motor winch assembly (not shown), transfer straps 80, control panel 82 and optionally, one or more strap positioning devices 84. The strap positioning devices 84 are secured to mattress support 88 and assist in redirecting the route of the transfer straps 80. The housing 32 encloses the motor winch assembly and may include transfer pulleys 85. Additionally, the housing 32 may define a plurality of housing slots 87. A control panel 82 that includes automated activators 83 is also accommodated by the housing 32. The housing 32 may be dimensioned and configured to fit any of several standard hospital beds, gurneys or any other patient support 46 and may be configured to replace a modular headboard fixture 79 that does not include the operating patient transfer device components.

The strap positioning devices 84 house one or more positioning pulleys 86 and defines a plurality of positioning slots 89. The strap positioning devices 84 may be configured to be affixed to mattress frames of any standard hospital bed, gurney or any other patient support 46. Transfer pulleys 85, housing slots 87, positioning pulleys 86, and positioning slots 89 constitute a plurality of paths, each path guiding a strap 80 as depicted in FIGS. 7 and 8. The straps 80 are attached to a clamping device 90 that is adapted for securing a pliable transfer sheet 91. Suitable embodiments for strap 80 and clamping devices 90 are disclosed in the above-incorporated U.S. Patents and U.S. Patent Applications.

Figure 6B:
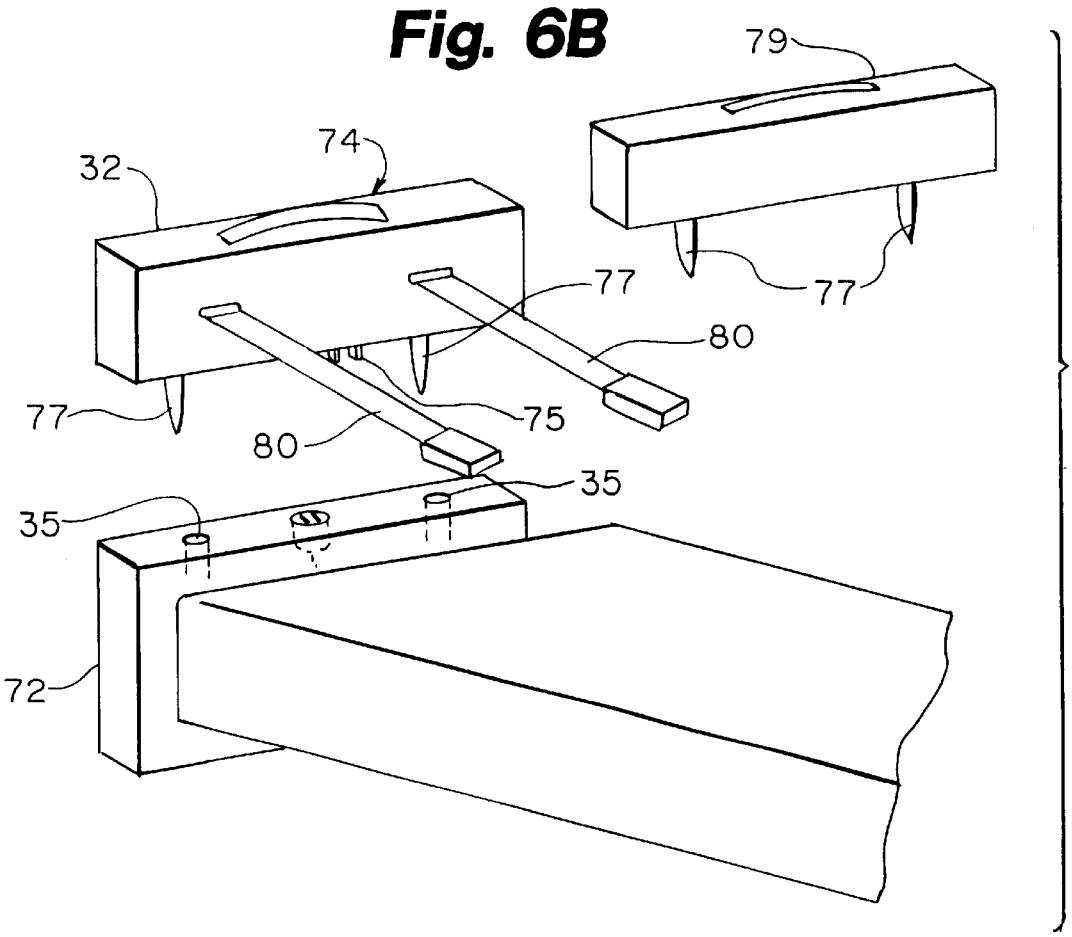

In various embodiments of the present invention, the housing 32 is dimensioned to replace the headboard, footboard or side rails of hospital beds, gurneys or other types of patient supports. FIGS. 6A–B depict two embodiments of a modular transfer device 74 that may be utilized to replace a modular headboard fixture 79 of a hospital bed or other patient support. The modular headboard fixture 79 may be a hollow housing or a solid structure, which include inserts 77 shaped to conform and fit with the mating assembly 35. As depicted in FIG. 6B, the modular headboard fixture 79 may be removed from the patient support 72 and the modular transfer device 74 may be positioned in its place. The modular transfer device may include electrical communication devices 75 that may channel power to the modular transfer device 74 through or from the patient support 72 when adjoined to the patient support 72.

Additionally, as can be seen in FIG. 8, patients may be repositioned using modular patient transfer device 74 when the hospital bed is in any number of positions. Moreover, when straps 80 are attached to a transfer sheet 91 upon which a patient is disposed, the patient may often be repositioned simply by raising the head portion of the mattress to an elevated position.

Figure 10:
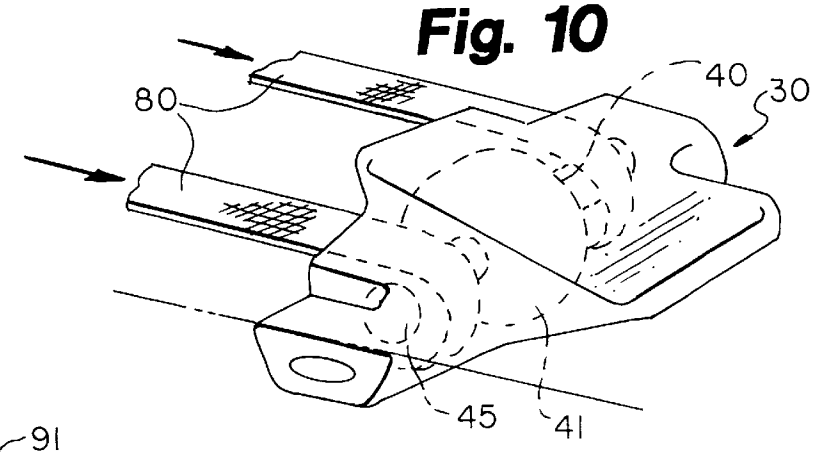
FIG. 10 is a detail perspective view of a patient transfer device of the present invention.
Figure 9:
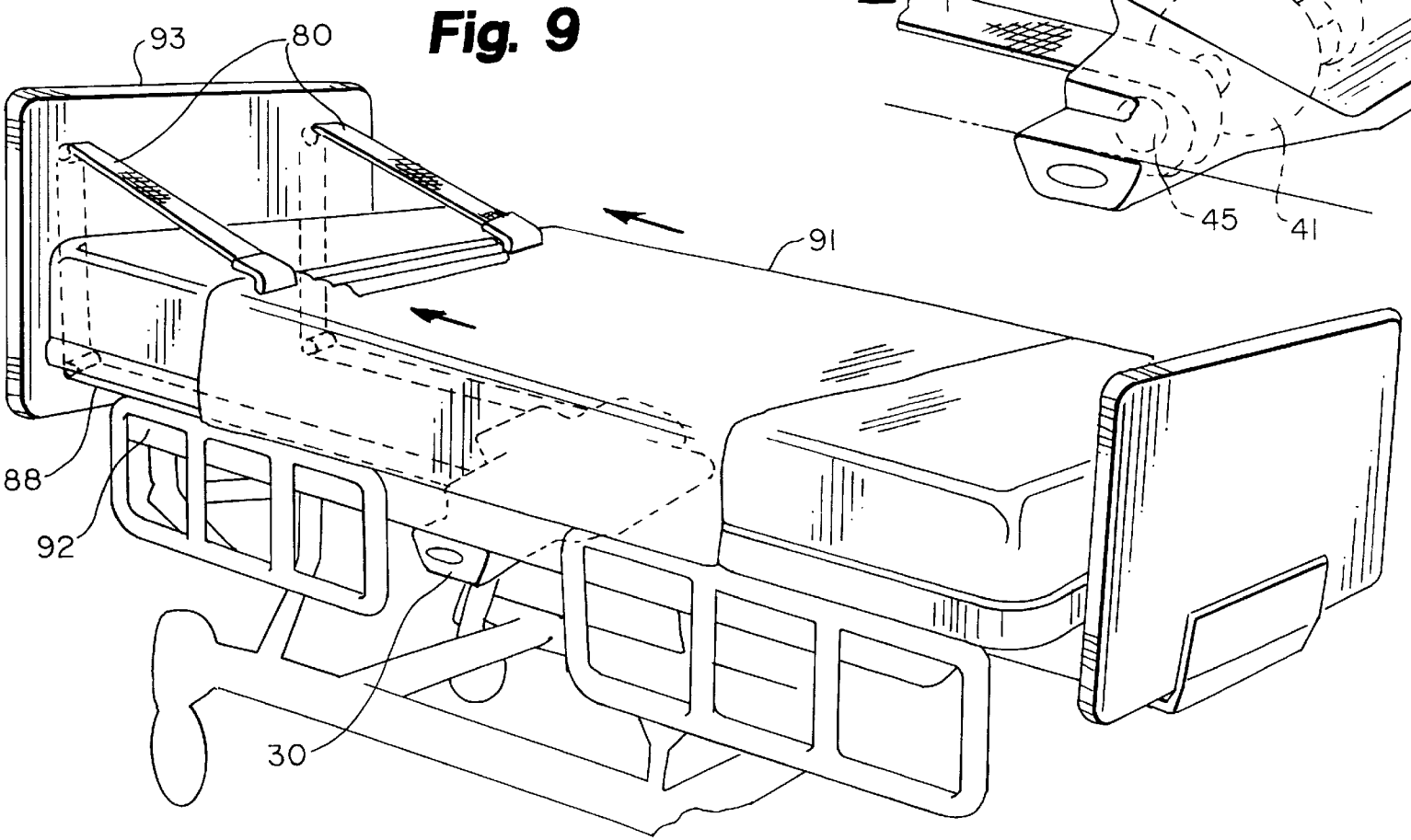
FIG. 9 is a perspective sectional view of another embodiment of the patient transfer device of the present invention.

Referring to FIGS. 9 and 10, a further embodiment of the invention is depicted. In this embodiment, patient transfer device 30 is located beneath bed frame 92 and generally includes housing 32, motor winch assembly 40, transfer straps 80, and positioning pulleys 86. In the present embodiment, the patient transfer device 30 is secured under the bed frame 92. The straps 80 extend around the positioning pulleys 86 and are secured to the transfer sheet 91. Pulleys 86 may be adjoined to the surface of the headboard 93 or positioned within the headboard 93 to facilitate the movement of the patient in a desired direction.

Figure 11:
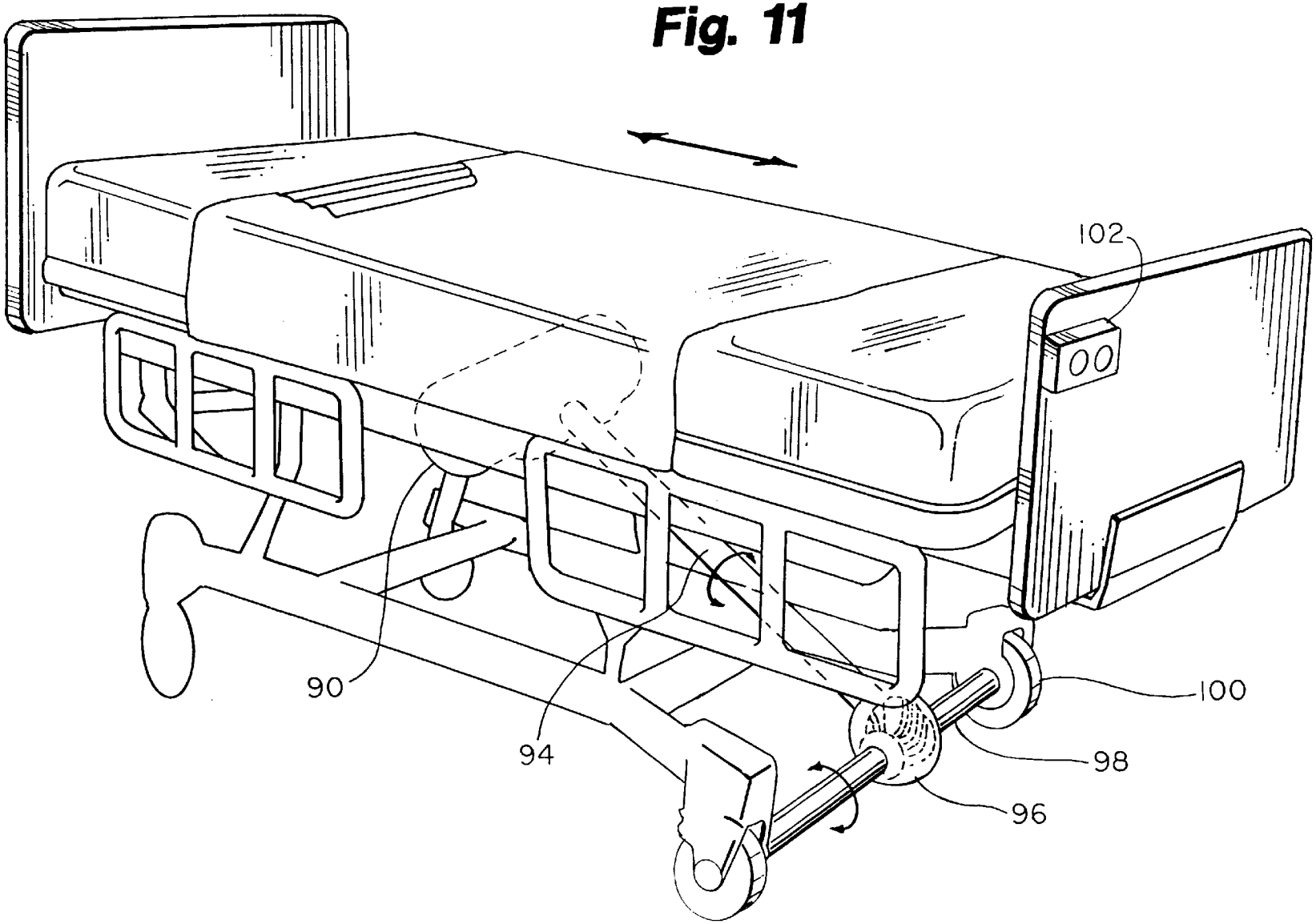
FIG. 11 is a perspective sectional view of a patient transfer device embodiment that includes a drive mechanism.

Referring to FIG. 11, patient transfer device 90 may optionally include a mechanism to mechanically move the patient support 46. The patient transfer device 90 of FIG. 11 includes a motor device 94 operably adjoined to a drive shaft 95. The drive shaft 95 extends to a gear box 96 that is operably connected to an axle 98 that provides a driving force to one or more drive wheels 100. Drive shaft 95 may optionally include drive chains, belts or any other appropriate drive mechanism. Additionally, gear box 96 may advantageously be a differential. Also, this embodiment of the present invention further may include a control panel 102 for activating and controlling the movement of the patient support 46.

Figure 12:
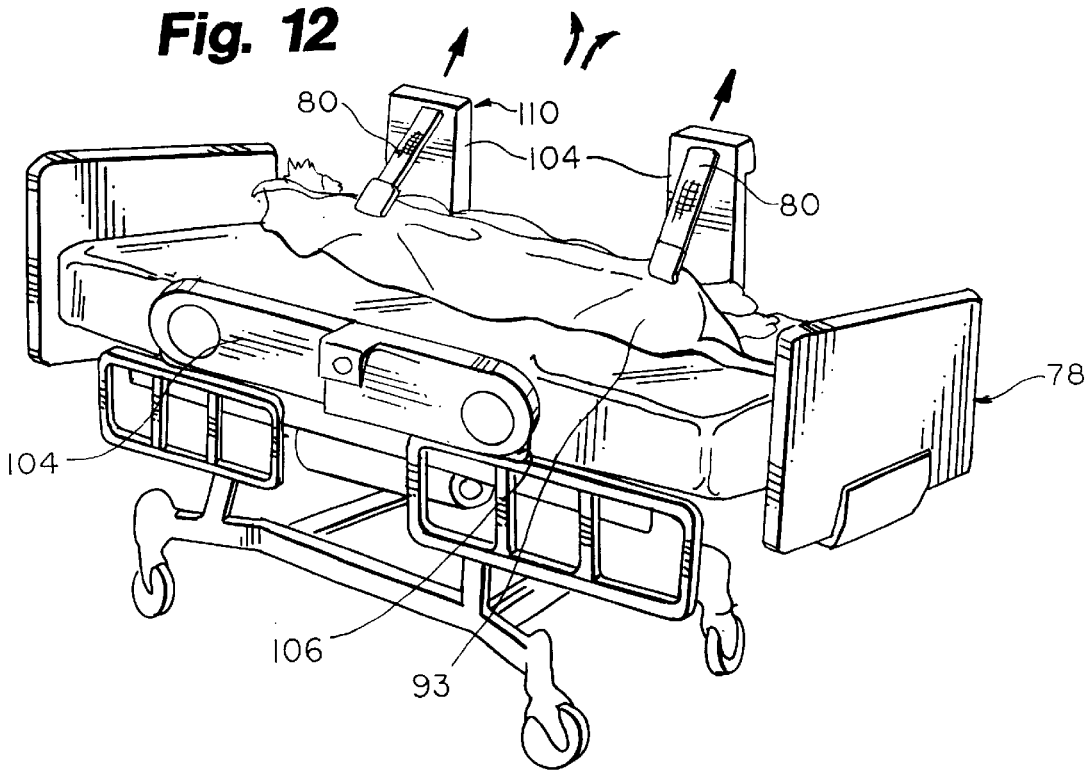
FIG. 12 is a perspective view of another embodiment of patient transfer device including foldable rollover members in the operating position.
Figure 13:
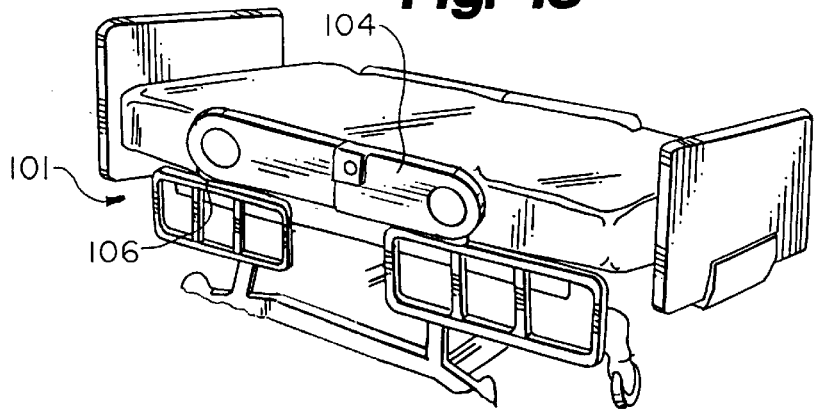
FIG. 13 is a perspective view of the folding rollover members in a storage position.

Another embodiment of the present invention is a patient transfer device 90 that includes retractable rollover members 104. FIGS. 12 and 13 depict retractable rollover members 104 that are advantageously secured to bed rails 106. The retractable rollover members 104 may be folded to a storage position 108 or folded to an operating position 110. The retractable rollover members may also be stored by other means such as telescoping downward towards the patient support 46. The retractable rollover members 104 include pulleys (not shown) that guide and facilitate the movement of the transfer straps 80 up the retractable rollover member and across the patient for securement to the transfer sheet 93.

FIGS. 14–21 depict a rolling patient transfer device 112. Rolling transfer device 112 generally includes housing 114, motor winch assembly 116, power assembly 111, column 118, and rolling base assembly 120. The column 118 may include a mating assembly 119 having connectors 122 that comprise electrical connectors 124, mechanical connectors 126 or both. Mechanical connectors 124 include but are not limited to clamps, hooks, magnets and other similar devices. An example of a mechanical connector 124 includes the clamping mechanism depicted in FIGS. 19 and 20. Furthermore, the column 118 may also optionally include a handle 128.

As previously mentioned, embodiments of the rolling transfer device 112 include a rolling base assembly 112 comprising a platform 130 adjoined to wheels or casters 132. The wheels 132 may be free rolling or powered. The column 118 may be adapted to secure to the platform 130 or may have portions thereof incorporated into the platform resulting in a unitary piece.

Figure 16:
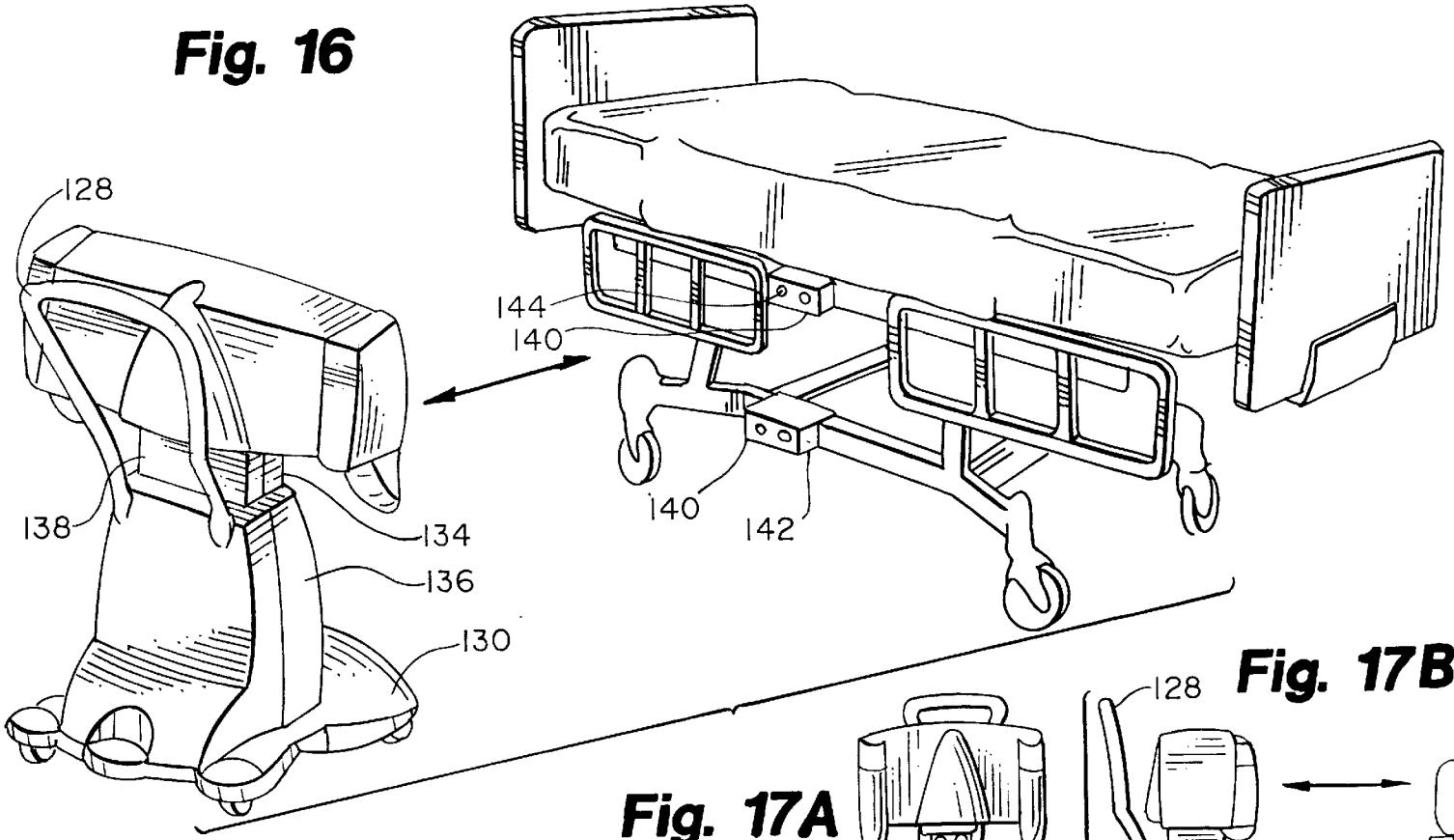
FIG. 16 is a perspective view of another embodiment of the patient transfer device.
Figure 17B:
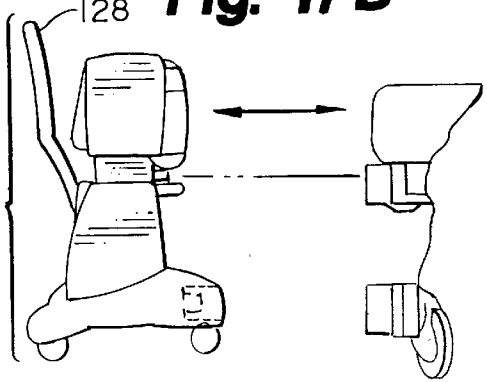
FIGS. 17A & B are front and side elevational views of the patient transfer device of FIG. 16.
Figure 17A:
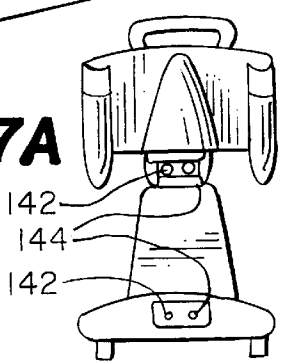

Referring particularly to FIGS. 16 and 17A and B, column 118 may include inner column 134 and outer column 136. Inner column 134 is slidably received within outer column 136 in a telescoping fashion such that housing 114 may be vertically adjustable. In one embodiment vertical adjustment of the patient transfer device 112 may be accomplished by movement of a handle 128 operably connected to the rolling transfer device 112.

Figure 18A:
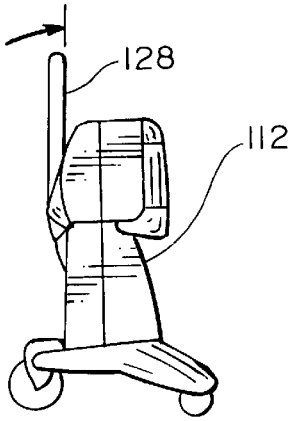
FIGS. 18A–C are side elevational views of the patient transfer device of FIGS. 17A & B in operation.
Figure 18B:
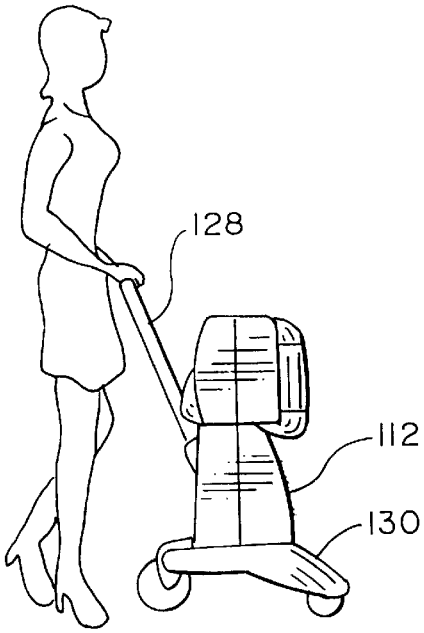
Figure 18C:
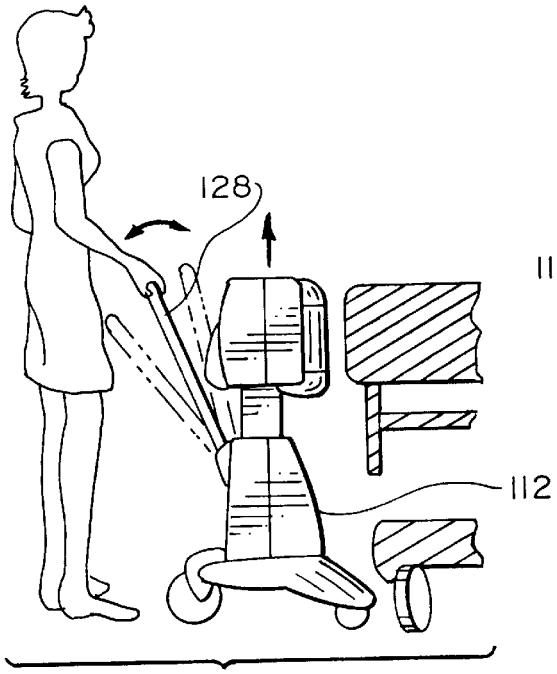
Figure 18D:
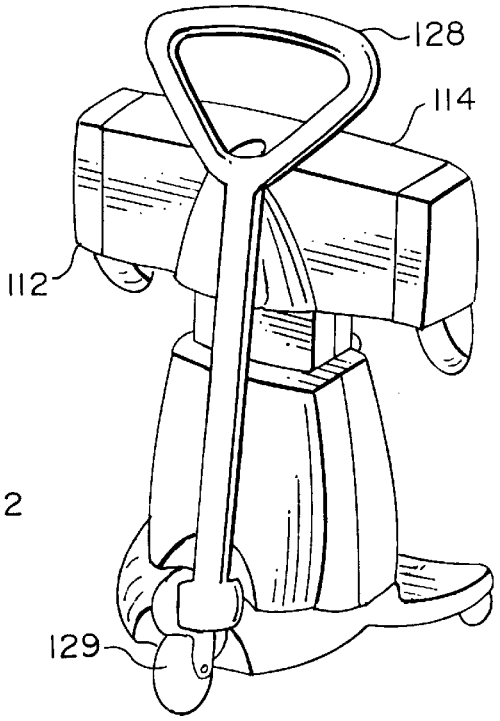
FIG. 18D is a perspective view of an embodiment of a rolling transfer device wherein the handle is operably connected to a wheel.

Referring particularly to FIG. 18A–C, handle 128 may be adapted to operate an elevating mechanism 138. The elevating mechanism 138 may include hydraulics, a screw or scissors jack or any other appropriate mechanism known to the art. Additionally, the handle 128 may also be utilized to maneuver the rolling transfer device 112. FIG. 18D depicts an embodiment of the rolling transfer device 112 wherein the handle 128 is operably connected to a wheel or castor 129. The embodiment depicted in FIG. 18D provides the operator the ability to easily maneuver and direct the rolling transfer device 112 in the desired location by simply manipulating the handle 128. Also the handle is adapted to fold upward to a position proximate to the housing 114 of the rolling transfer device 112, thereby allowing for placement of the device 112 in tight locations, i.e. between patient supports and walls. It is noted that the rolling transfer device 112 depicted in FIG. 18D may also include the features described above for adjusting height.

The connectors 122 are matable to bed frame connectors 140 as shown in FIG. 16. Bed frame connectors 140 may include one or more mechanical interfaces 142, one or more electrical interfaces 144 or both. Mechanical interfaces 142 may be releasable connectable to bed frame connectors 140. Electrical interface 144 may be configured to draw electrical power to operate motor winch assembly 40, to charge power supply 54 if self contained and to provide power wheels 132 if powered.

Figure 19A:
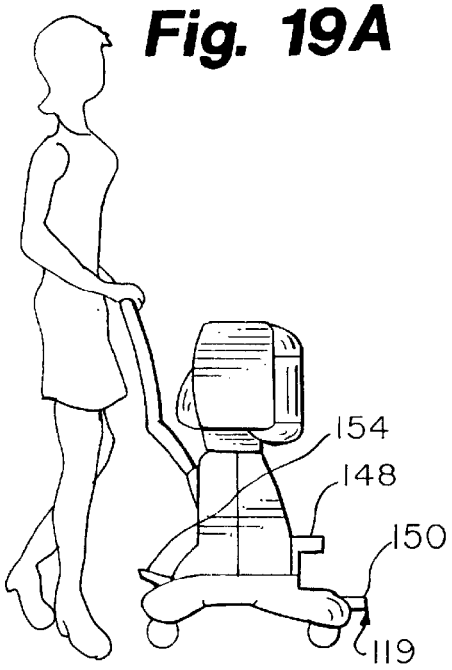
FIGS. 19A & B are side elevational views of another embodiment of the patient transfer device of the present invention that includes a clamping mechanism.
Figure 19B:
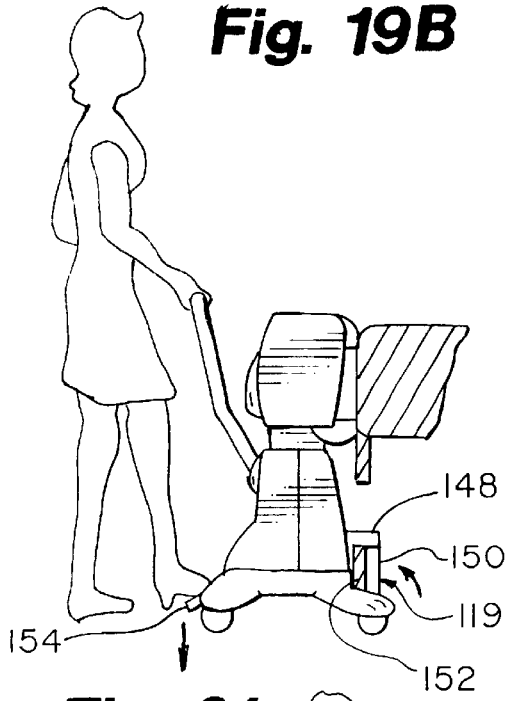

Referring particularly to FIGS. 19A and B, 20, and 21, either column 118 or rolling base assembly 120 may further include a mating assembly 119 in the form of one or more clamping mechanisms 146. In one embodiment of the present invention, the clamping mechanisms 146 includes a fixed member 148 and clamping member 150. The clamping member 150 is movably operable to engage patient support member 152 and may lock into position upon engagement with the patient support member 152. Additionally, the clamping member 150 may be actuated or released by foot pedal 154 or any convenient actuating mechanism, such as a button, lever, knob or other similar device. The clamping member 150 actuation or release may be electrical, hydraulic or mechanical in nature.

FIGS. 22–25 depict one embodiment of the motor winch assembly 116 that may be utilized in the patient transfer devices 30 of the present invention. The motor winch assembly 116 includes motor 340, motor shaft 342, first bevel gear 344, second bevel gear 346, axle shaft 348, a plurality of magnetic clutch assemblies 350, a plurality of slip plates 352, and a plurality of drum assemblies 354. Motor 340 is mounted generally vertically proximate a lower surface of plate 270 by means of fasteners such as machine screws or bolts. Motor shaft 342 extends from motor 340 through plate 270. Respective first and second bevel gears 344 and 346 are affixed to motor shaft 342 and axle 348. Suitable exemplary magnetic clutch assemblies 350, motor 340, slip plate assemblies 352, and drum assemblies 354 are depicted and cooperate with axle 348 in a manner substantially similar to that depicted and described in above-referenced U.S. patent application Ser. No. 09/057,139 and U.S. patent application Ser. No. 09/174,110.

One embodiment of a motor 340 is a permanent magnet, parallel shaft, DC brush gear motor, operating at 12 volts DC and generating approximately ⅛ hp. In this embodiment, motor 340 rotates motor shaft 342 at an output speed of between about 25 rpm and 75 rpm and attains an output torque range of between approximately 300 in-lbs at 25 rpm and 100 in-lbs at 75 rpm. An exemplary motor may be obtained from Byson Gear and Engineering Corporation, Downers Grove, Ill. However, it is noted that other types of motors known to those skilled in the art may be utilized with the transfer device of the present invention.

Figure 26:
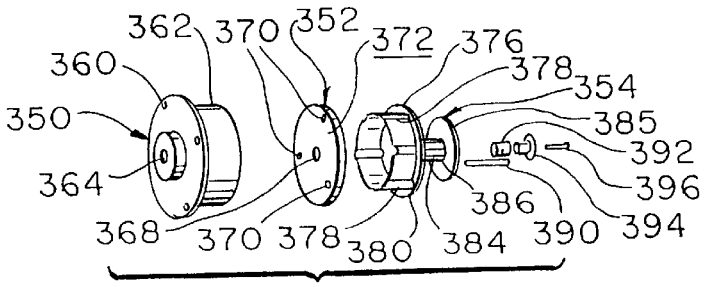
FIG. 26 is an exploded view of one embodiment of a magnetic clutch assembly, slip plate, and drum assembly present in the embodiment of FIG. 22.
Figure 27:
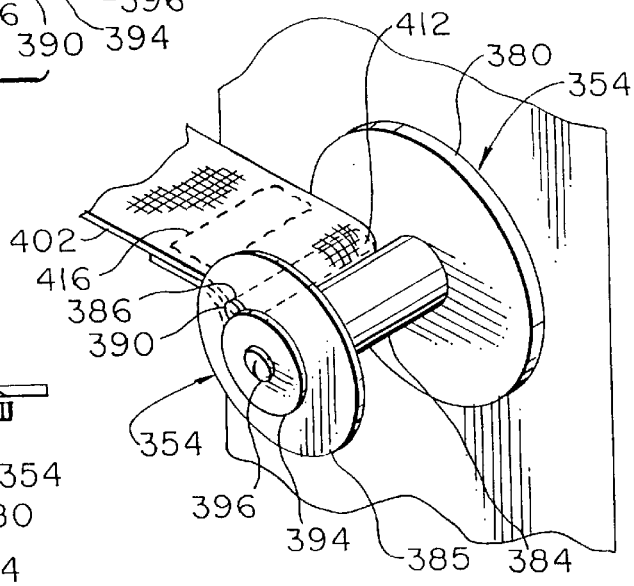
FIG. 27 is a perspective view of a web attached to the drum assembly of the embodiment of FIG. 22.
Figure 28:
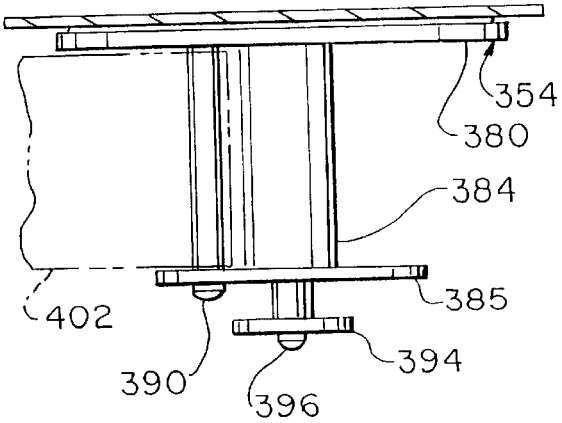
FIG. 28 is a plan view of the web and drum assembly of FIG. 27.
Figure 29A:
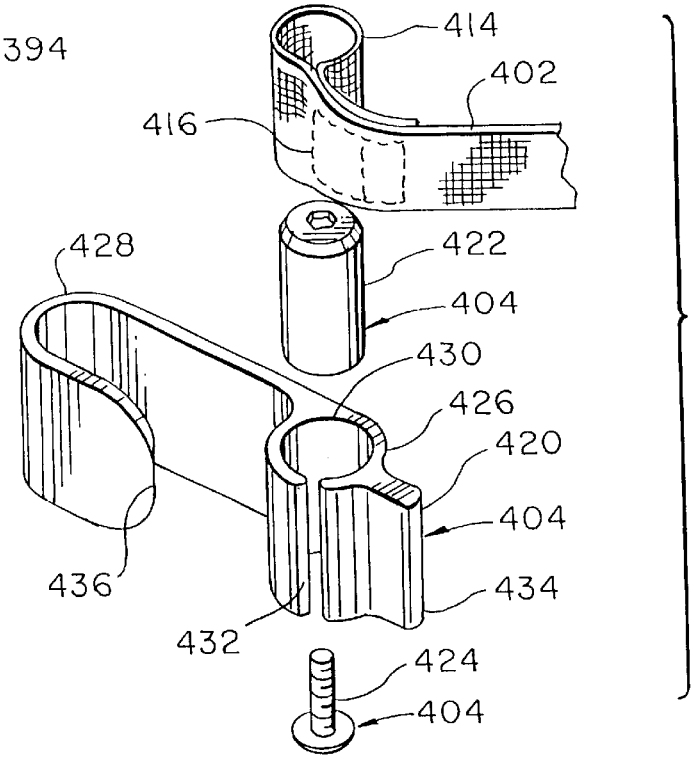
FIG. 29A is an exploded view of the strap of FIG. 27 and a transfer hook assembly.
Figure 29B:
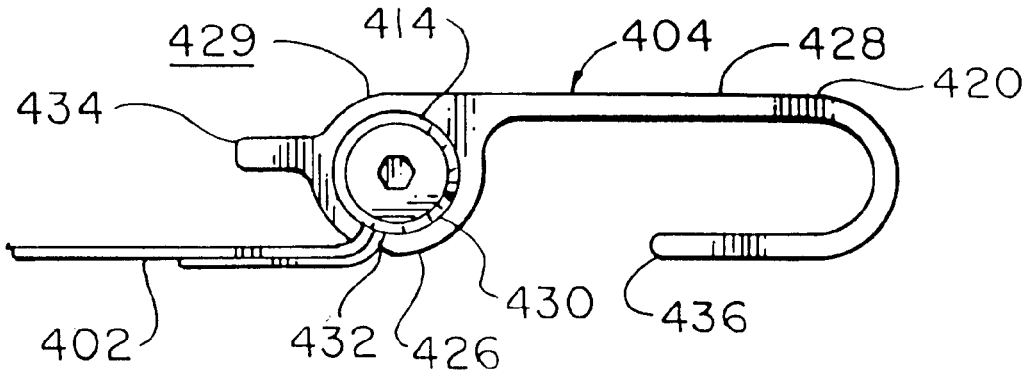
FIG. 29B is a side view of the transfer hook of FIG. 29A.

As seen in FIG. 26, each magnetic clutch assembly 350 includes disk 360 and cylindrical housing 362. A generally coaxial bore 364 extends through magnetic clutch assembly 350. In this embodiment, bore 364 has a diameter of about ½ inch to accommodate axle 348 and disk 360 has a diameter of approximately 4.9" (±0.5"). Cylindrical housing 362 has a diameter of approximately 4.2" (±0.5") and a depth of approximately 1.8" (±0.5"). An exemplary magnetic clutch develops a torque of 22 lb-ft, and attains a coil power of 28 watts, an armature hub inertia of $161\times10^{-4}$ lb-ft$^2$, a rotor inertia of about $172\times10^{-4}$ lb-ft$^2$, and generates 3 hp at 1800 rpm. Disk 360 may be mounted to outboard surfaces of vertical elements 250 and 252 by fasteners such as screws or bolts. Magnetic clutch assembly 350 is mounted such that axle 348 extends generally coaxially through bore 364. Axle 348 and magnetic clutch 350 may be affixed by a keyway combination (not shown). Each slip plate 352 defines bore 368, a plurality of peripheral holes 370, and presents an inboard surface 372. Magnetic clutch assembly 350 and slip plate 352 are designed to perform a patient displacement so as to provide maximum comfort to the patient. In one embodiment, when magnetic clutch assembly 350 and slip plate 352 are actuated, a gradual acceleration to, and deceleration from, normal operating speed occurs rather than immediate commencement or cessation of normal operating speed, each of which would otherwise result in an abrupt jerk. In yet another embodiment, magnetic clutch assembly 352 and slip plate 352 remain engaged when axle 348 rotation ceases, thereby preventing the web from unwinding from drum assembly 354 until magnetic clutch assembly 350 and slip plate 352 are disengaged.

Each exemplary drum assembly 354 includes cylindrical member 376. Four threaded extensions 378 may extend peripherally from cylindrical member 376 and disk 380 may be unitarily joined to cylindrical member 376. Disk 380 presents an outboard surface and defines a threaded aperture. Cylindrical (spool) member 384 coaxially extends from the outboard surface of disk 380. Outboard disk 385 extends generally coaxially and radially from cylindrical member 384. Outboard disk 385 defines aperture 386 and presents an outboard surface. Aperture 386 is generally aligned with the threaded aperture defined in disk 380 in this embodiment.

Also in this embodiment, a fastener such as a screw extends through each aperture 370 and is threadably disposed within each threaded extension 378. Screw 390 is extended through aperture 386 and is threadably received within the threaded aperture defined in disk 380. Bores are coaxially formed within slip plate 352 and drum assembly 354, respectively, such that axle 348 may be received there within. Drag cap spring 392 is compressibly held in place by drag cap 394. Drag cap 394 cooperates with a fastener such as screw 396 threadably received within an aperture proximate each terminus of axle 348. In this embodiment, power train 106 is dimensioned such that cylindrical members 384 may be spaced between about 18 inches and 22 inches, between about 19 inches and 21 inches, or about 20 inches, on center.

FIGS. 25 and 27–29 depict one embodiment of the strap and hook assembly 47 and the components utilized in this embodiment. The strap and hook assembly 47 may include transfer strap 402, transfer hook assembly 404, stop 406, and an exemplary transfer rod embodiment. However, it is contemplated that other means of securing pliable underlayments such as transfer sheets may be used with this invention. Suitable securing means include various clamps and/or tethers disclosed in above-referenced U.S. Pat. No. 5,737,781. This invention is also contemplated to include securing means disclosed in above-referenced U.S. Provisional Application No. 60/084,519 and U.S. Provisional Application No. 60/092,286. With the exception of stop 406, exemplary strap and hook assembly 47 may be substantially equivalent to that disclosed in above-referenced U.S. patent application Ser. No. 09/057,139 and U.S. patent application Ser. No. 09/174,110. Loops similar to loop 414 are formed at each end of strap 402. Loops 414 are formed by such means known to the art as stitching 416 or gluing (not shown).

One embodiment of the transfer hook assembly 404 includes transfer hook 420, joint connector 422, and joint connecting bolt 424. Exemplary transfer hook 420 is unitary, but may be envisioned as including strap retaining member 426 and hook member 428. Strap retaining member 426 displays exterior surface 429 and defines bore 430 and slot 432. Flange 434 extends from strap retaining member 426. Hook member 428 and strap retaining member 426 cooperate to define gap 436 therebetween. Strap 402 is attached to transfer hook 420 by inserting joint connector 422 within loop 414 and disposing loop 414 and inserted joint connector 422 in bore 430 such that web 402 extends through gap 432. Joint connector 422 is then secured within bore 430 by threading joint connector bolt 424 in joint connector 422. Web 402 is attached to drum assembly 354 by aligning loop 412 with aperture 386 and the aperture defined in disk 380, then inserting screw 390 through aperture 386 and loop 412 and subsequently threading screw 390 into the aperture defined in disk 380. Dimensions and materials used in one embodiment of transfer hook assembly 404 may be found in above-referenced U.S. patent application Ser. No. 09/057,139 and U.S. patent application Ser. No. 09/174,110. In one embodiment, strap 402 is nylon webbing 1½ inch in width and 73¾ inches in length, but is 70 inches in length after loops 412 and 414 are formed.

Figure 14:
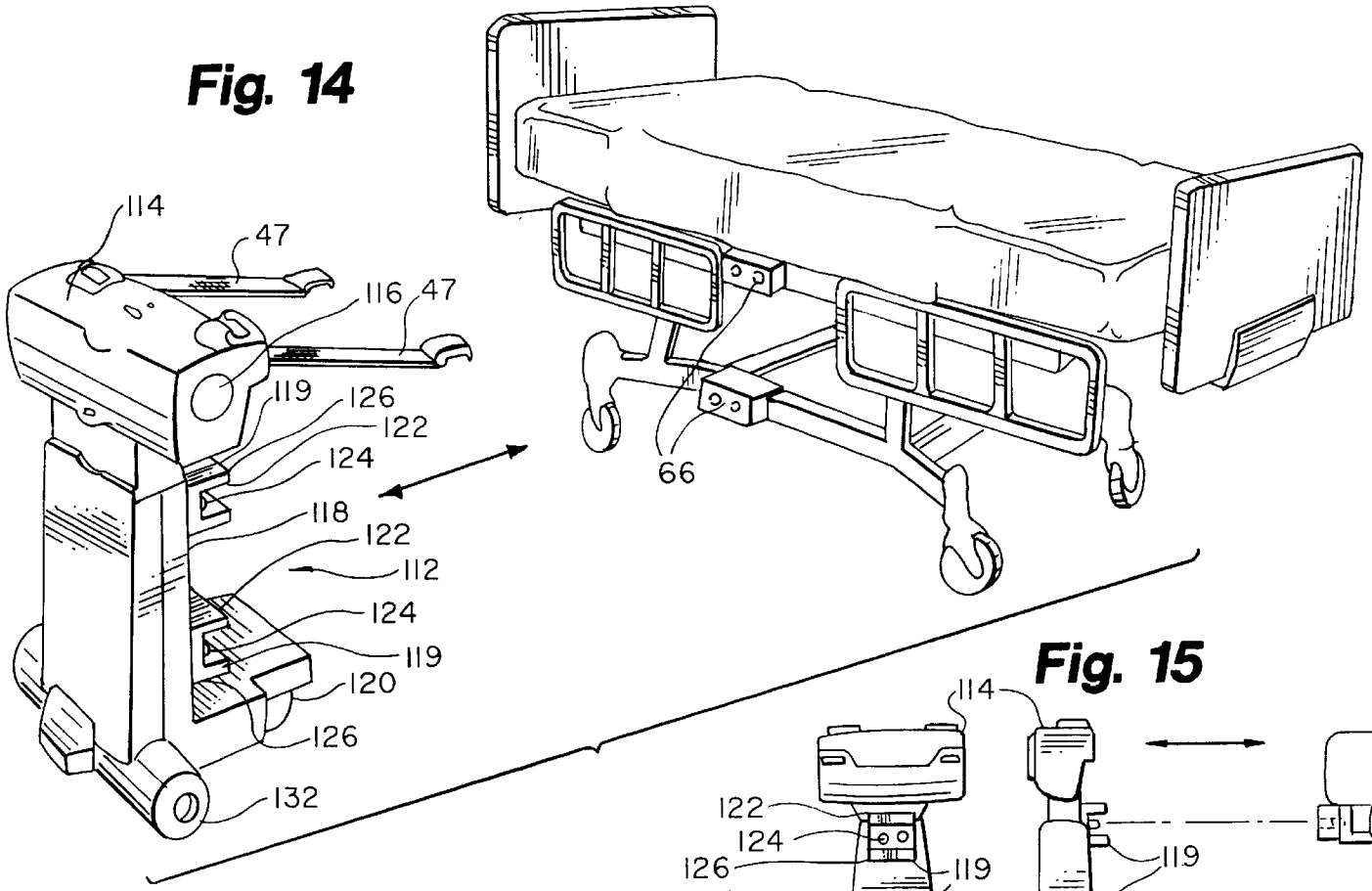
FIG. 14 is a perspective view of an embodiment of a rolling patient transfer device of the present invention.
Figure 15:
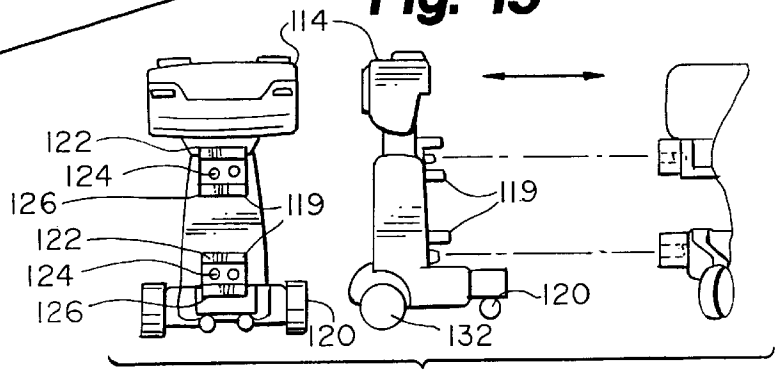
FIG. 15 is a front and side elevation view of the patient transfer device of FIG. 14.
Figure 22:
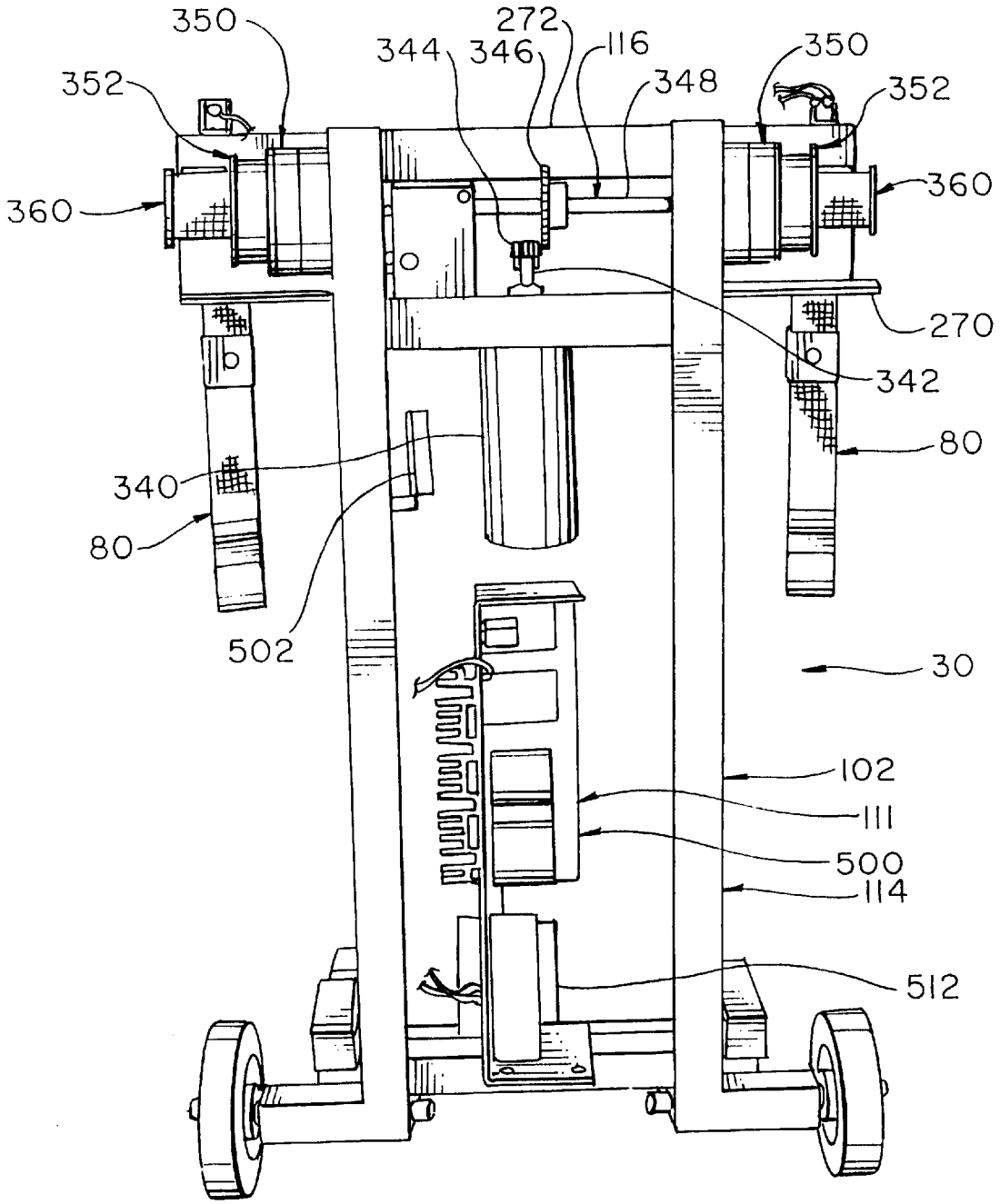
FIG. 22 is a rear view of an embodiment of a rolling transfer device with the rear panel removed.
Figure 23:
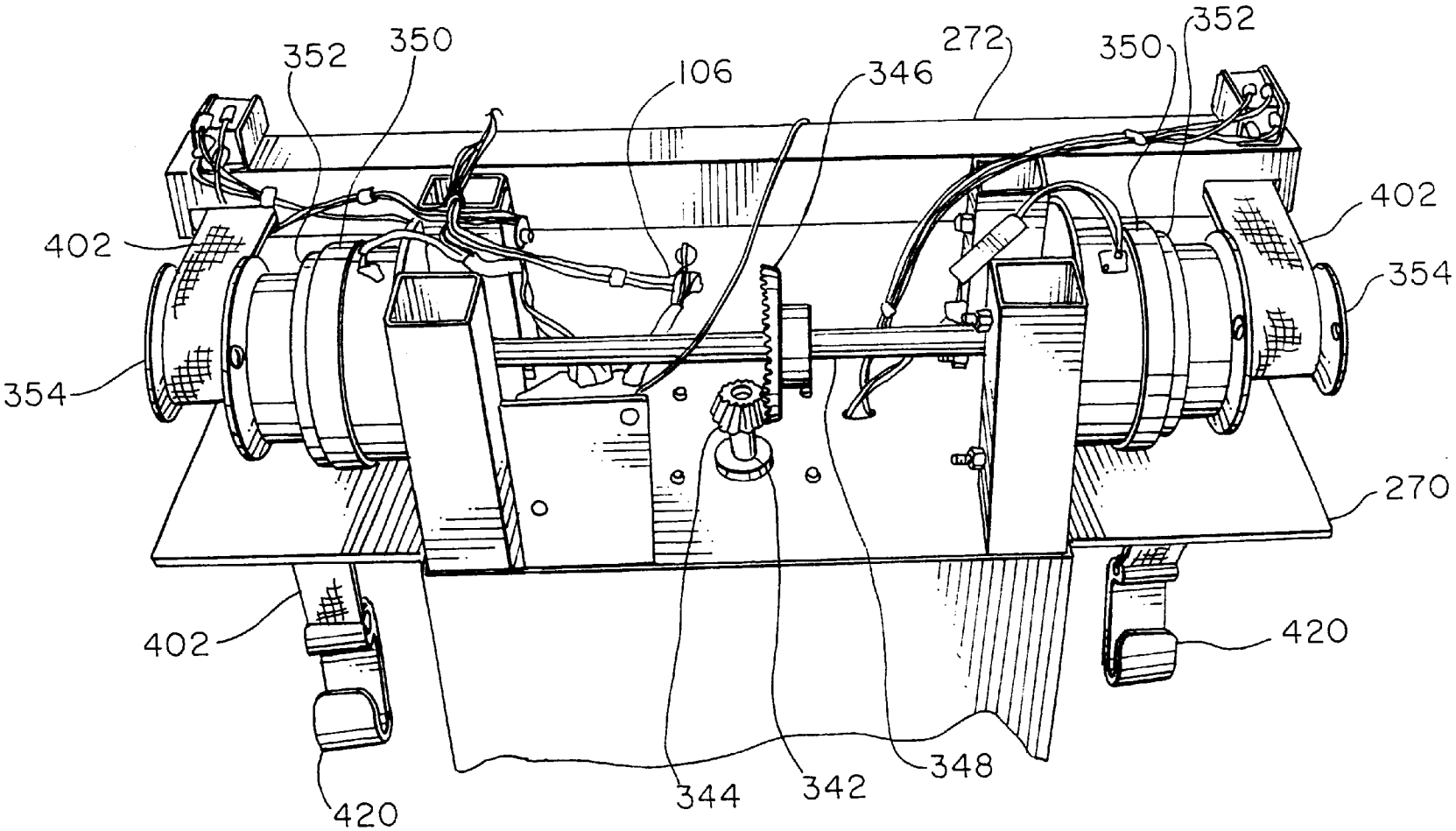
FIG. 23 is a view of an embodiment of a patient transfer device with the upper housing removed.
Figure 24:
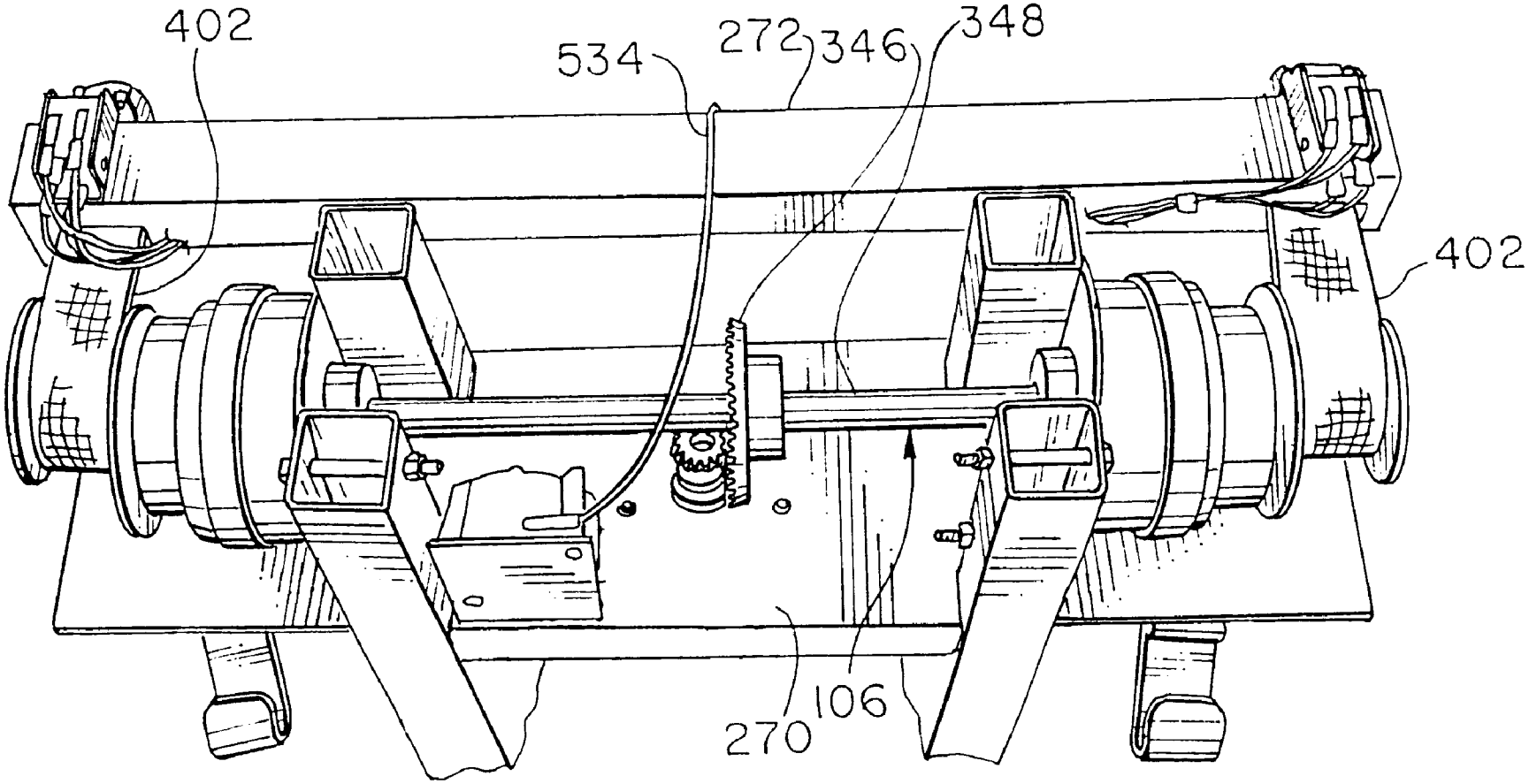
FIG. 24 is another view of an embodiment of a patient transfer device with the upper housing removed.
Figure 25:
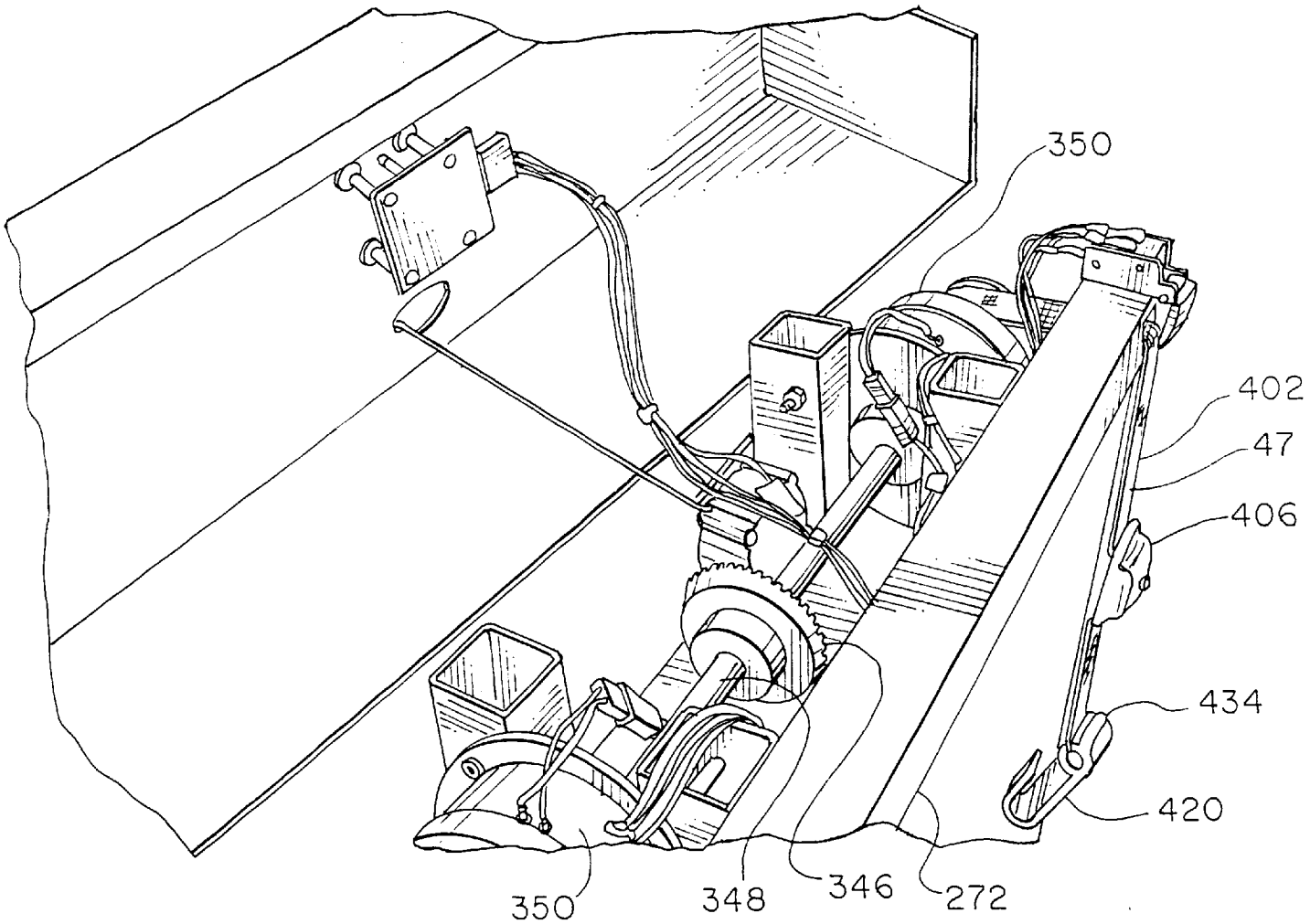
FIG. 25 is a perspective view of an embodiment of a patient transfer device with the upper housing removed.

Referring to FIGS. 22–24, the power system 111 includes power supply assembly 500 that is operably connected to circuit board 502, control panel (not shown) and motor 340. Power supply assembly 500, in turn, includes power supply cord 510 and rectifier 512. The power supply cord may be adjoined to an exterior power source or may be operably connected to electrical connectors 124 that may be received by electrical interfaces (as shown in FIGS. 14 and 15) adjoined to the patient support 46. Rectifier 512 converts commonly available AC, 60 Hz, 115 V current to DC, 12 V required by motor 340. However, other rectifiers converting other forms of alternating current are contemplated to be within the scope of this invention. Furthermore, other power supply systems such as those depicted and described in above-referenced U.S. patent application Ser. No. 09/545,538, U.S. patent application Ser. No. 09/057,139 and U.S. patent application Ser. No. 09/174,110 are contemplated to be within the scope of this invention as well.

Figure 30:
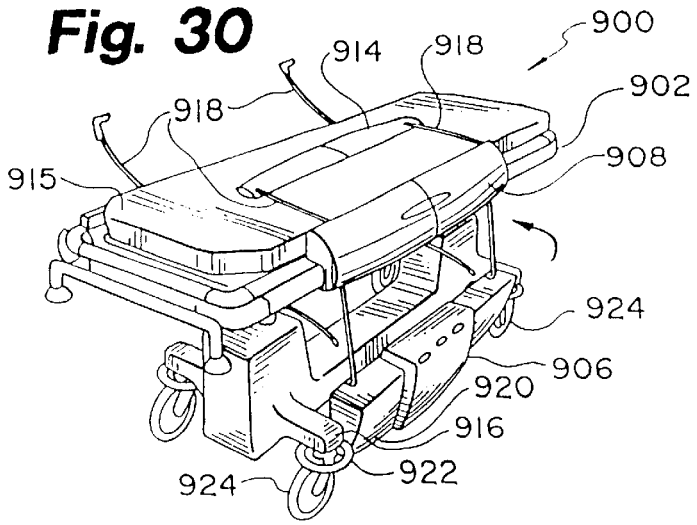
FIG. 30 is another embodiment of the transfer system of the present invention, whereby a patient may be bidirectionally transferred without the necessity of reinstalling this embodiment on another bed or cart.
Figure 31A:
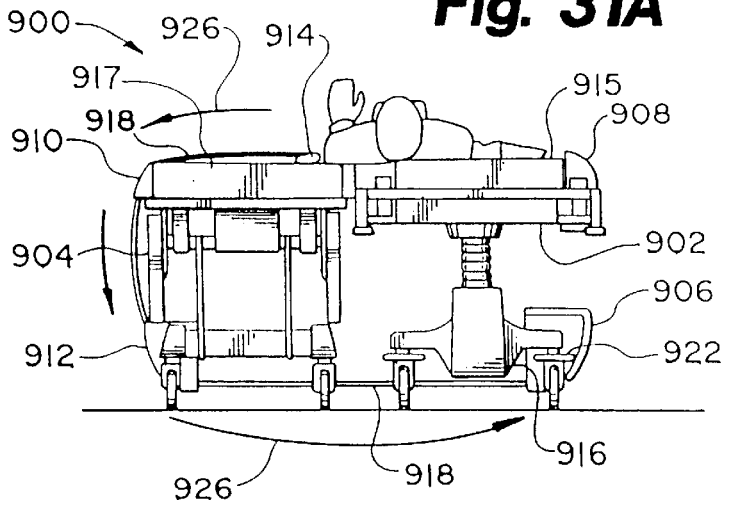
FIG. 31A is a side plan view of the embodiment of FIG. 30, wherein a patient is being transferred away from the bed on which the embodiment is installed.

Patient transfer device 900, as depicted in FIGS. 30 and 31A and B, broadly includes bed 902, cart 904, motor-winch unit 906, perpendicular transfer units 908, 910, 912, clamp 914 and a plurality of belts discussed below. Although depicted as cart 904, a bed or other horizontal surface may be used and still be within the spirit and scope of the present invention. Motor-winch unit 906 may be attached to base 916 of bed 902. Perpendicular transfer unit 908 is attached to the upper frame of bed 902. Another perpendicular transfer unit 910 is attached to the upper frame on adjoining cart 904. Still another perpendicular transfer unit 912 is attached to the lower frame of cart 904.

As shown in FIG. 30, a pair of straps 918 may extend generally upwardly from motor-winch unit 906 through perpendicular transfer unit 908, finally extending horizontally on mattress 915. Straps 918 are then attached to clamp 914 in any manner such as described herein. Alternately, straps 918 may proceed horizontally from motor-winch unit 906, beneath bed 902 and cart 904 and through perpendicular transfer unit 912. Extending generally upwardly and vertically from perpendicular transfer until 912, straps 918 pass through perpendicular transfer unit 910, then onto mattress 917. On mattress 917, straps 918 may be attached to a clamp such as a clamp of the present invention. In one embodiment, motor-winch unit 906 may be attached to bed 902 by means of a mating assembly in the form of rings 922 extending from housing 920. Rings 922 may enclose an upper portion of casters 924 on which bed 902 is mounted. It is also noted that the motor winch unit 906 may include electrical connectors (not shown) that plug into the bed 902. The electrical connectors may be utilized to supply power to the unit 906 derived from a power source located within or channeling through the bed 902.

Figure 31B:
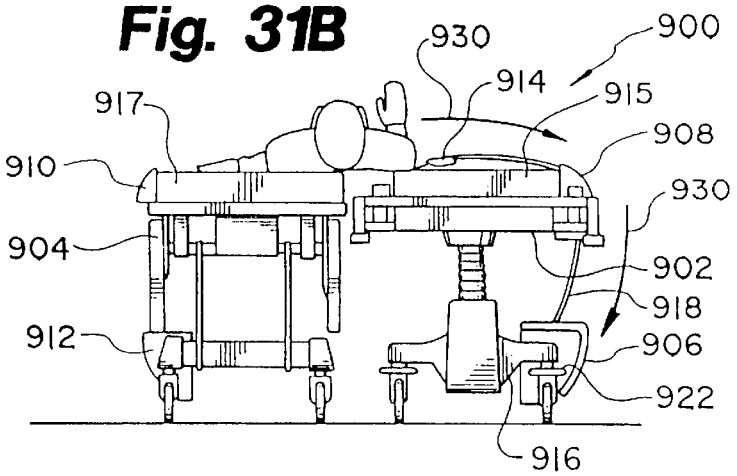
FIG. 31B is a side plan view of the embodiment of FIG. 30, wherein a patient is being transferred onto the bed or cart onto which the embodiment is installed.
Figure 32:
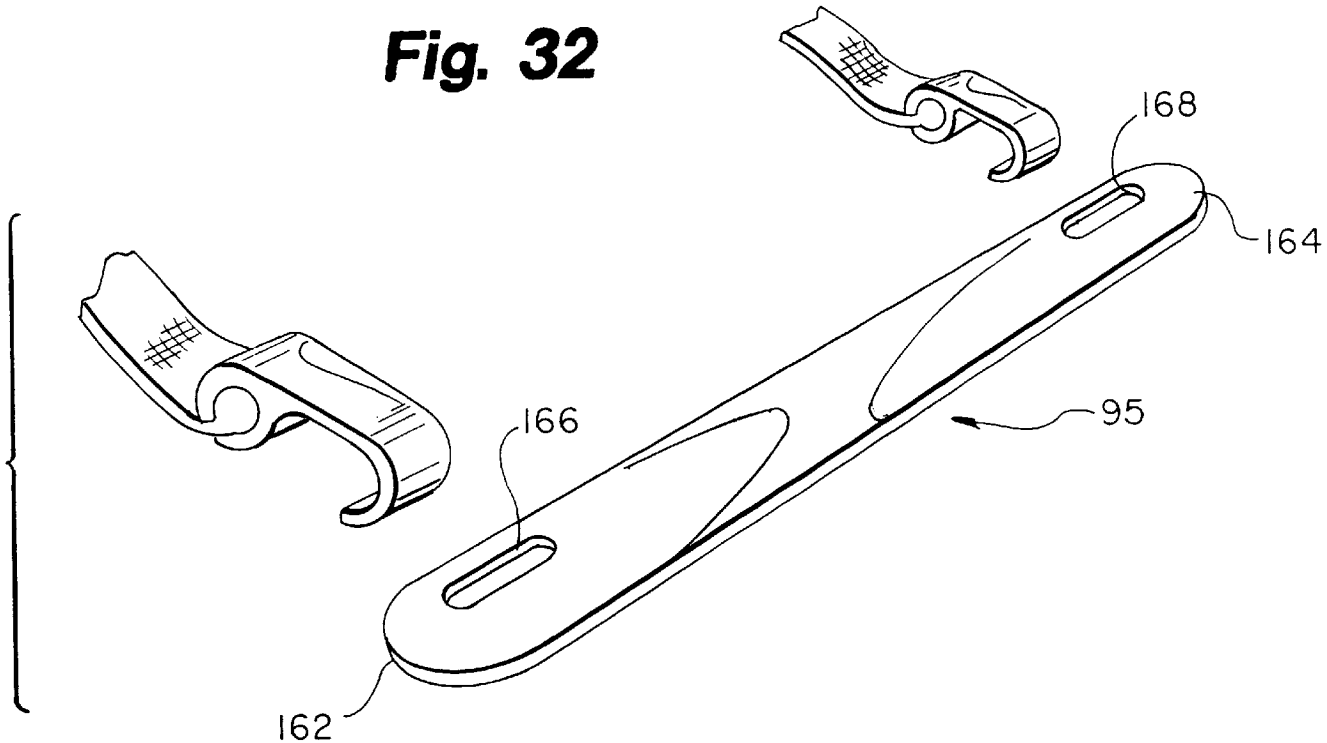
FIG. 32 is a perspective view of an embodiment of a transfer bar.
Figure 33:
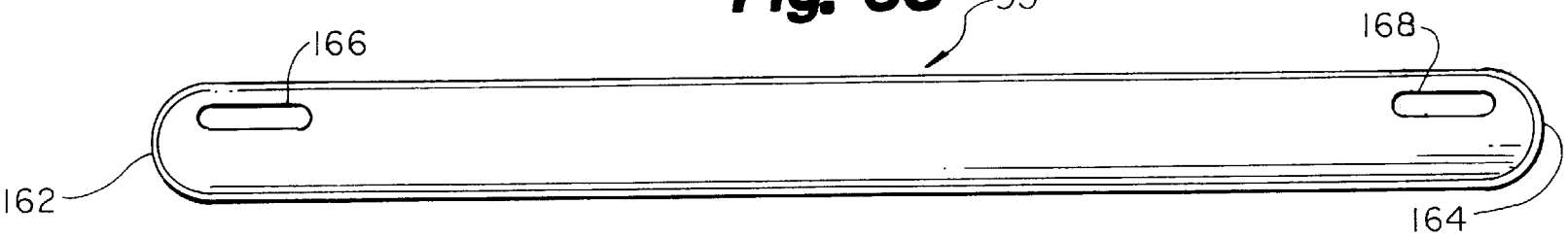
FIG. 33 is a top plan view of a transfer bar that includes slots offset from center.
Figure 37:
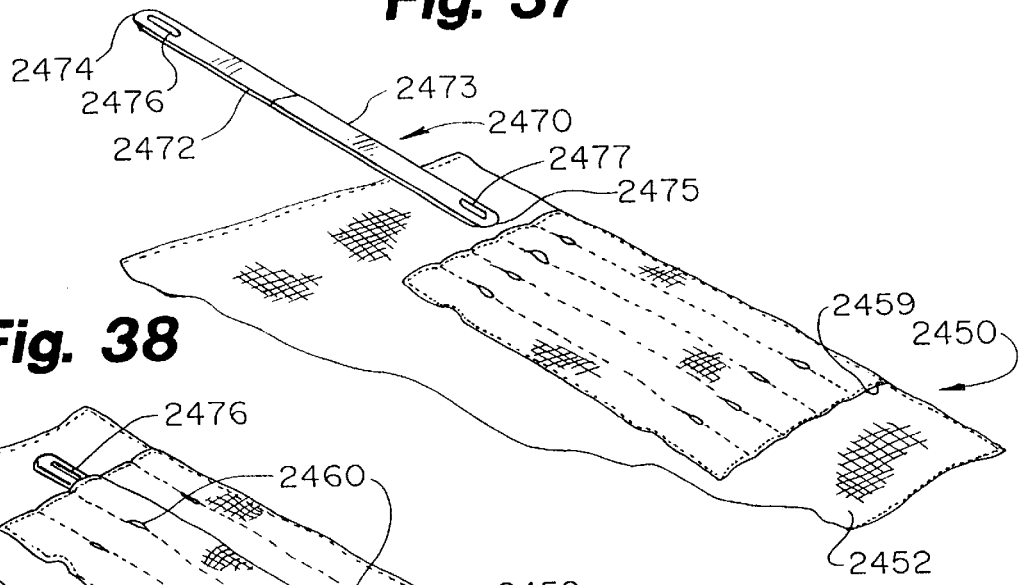
FIG. 37 is a fragmentary perspective view of the sheet of FIG. 34 with a repositioning bar being inserted therein.
Figure 38:
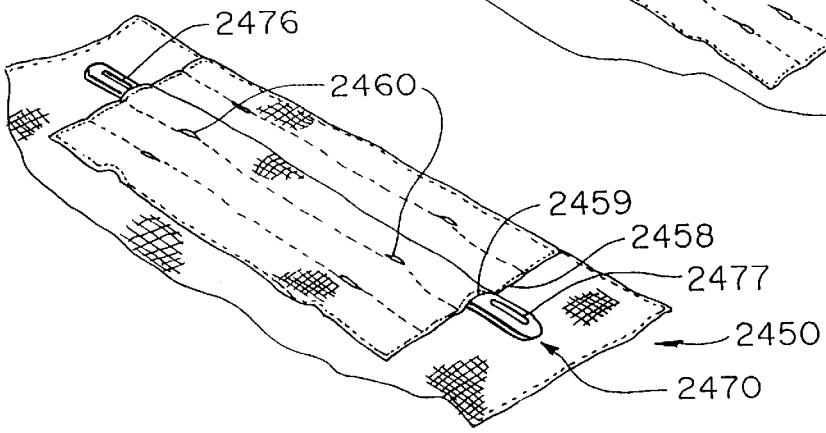
FIG. 38 is a fragmentary perspective view of the sheet of FIG. 34 with a repositioning bar in place.

The embodiments of the patient transfer device 30 may be utilized in conjunction with a transfer sheet 93 and a transfer bar 95. FIGS. 31 and 32 depict embodiments of the transfer bar 95. As previously suggested, the transfer bar 95 may be used in conjunction with transfer sheet 93. The transfer bar 95 is a unitary member that may comprise a metal or plastic material. However, other embodiments of transfer bar 95 may comprise more than one member in construction. It is preferable to produce the transfer bar with a flexible plastic material to reduce or prevent injury to the patient when performing a patient reposition motion or transfer. Transfer bar 95 defines first and second ends 162, 164 and first and second bar slots 166, 168. It is noted that other embodiments of the transfer bar 95 may include more than two bar slots. One embodiment of the transfer bar 95 is proportioned, and first and second bar slots 166, 168 are spaced apart, such that bar slots 166, 168 are exposed when transfer bar 95 is disposed in a pocket of the transfer sheet 91 (a description of one embodiment of the transfer sheet is described below). In one embodiment slots 166, 168 are spaced apart about 24 inches on center and transfer bar is about one inch wide, one-fourth inch in depth, and 26¾ inches in length. While bar slots 166, 168 are shown generally centered, as shown in FIG. 32, first and second bar slots 166, 168 may be offset as well, as shown in FIG. 33. Offset bar slots tend to maintain transfer bar 95 in a flattened position during a patient transfer or pullup, thereby decreasing the likelihood of transfer bar 95 being bent. Bar slots 166, 168 are dimensioned to accommodate a transfer or repositioning hook such as transfer hook 81. Sheet slots 2460 may also be formed proximate the pockets in the transfer sheet 91 and are also proportioned to accommodate connecting members such as transfer hook 81 (See FIG. 34). The transfer hook 81, in this example, may extend through the sheet slot 2460 in the transfer sheet 91 and attach to transfer bar 95 disposed therein.

Figure 34:
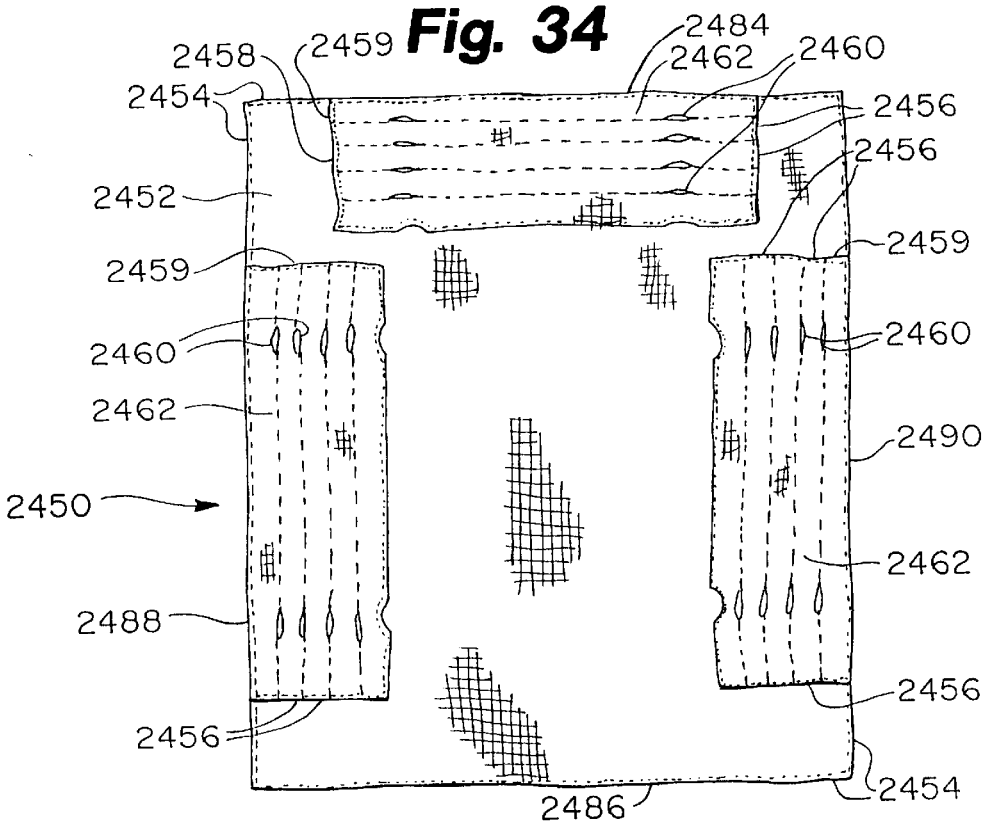
FIG. 34 is a top plan view of a first embodiment of a transfer sheet cooperating with a plurality of attaching members to form pockets.
Figure 36:
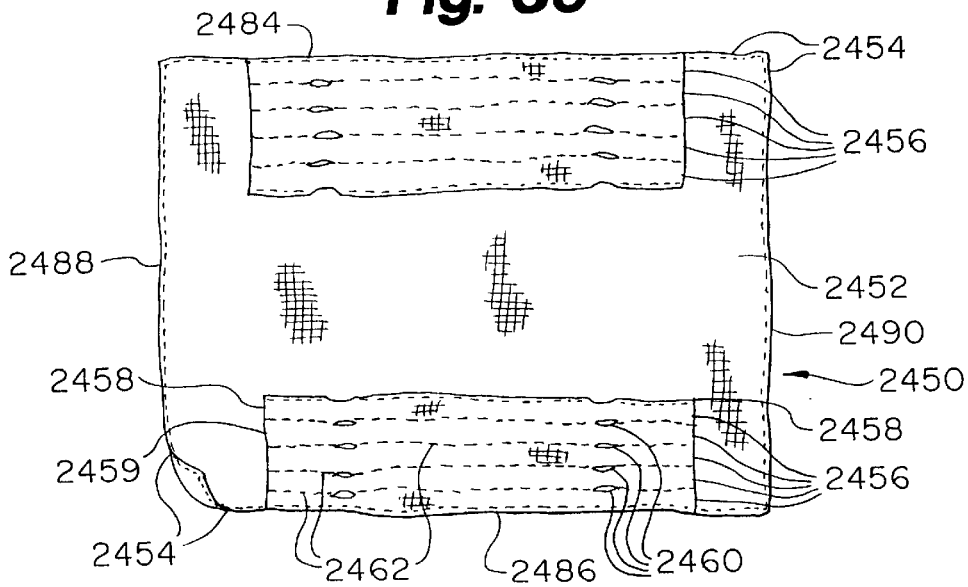
FIG. 36 is a top plan view of a third embodiment of the sheet of FIG. 34.
Figure 39:
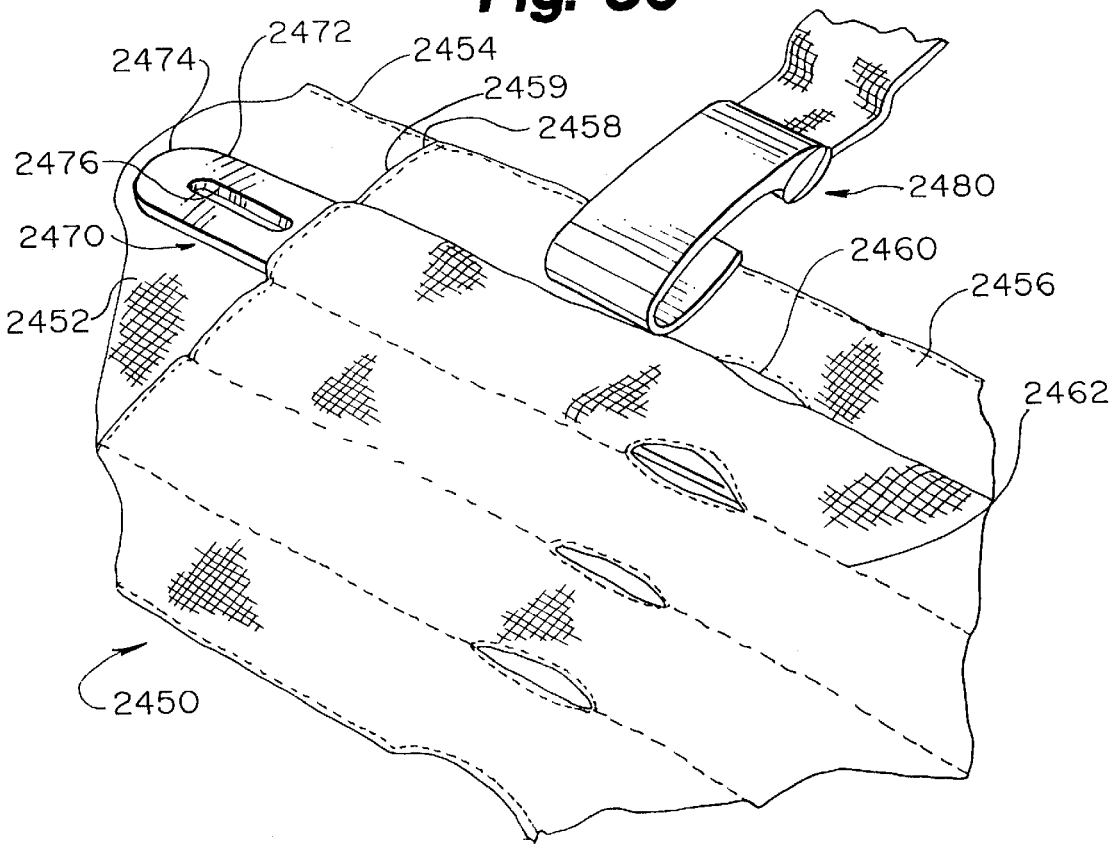
FIG. 39 is fragmentary perspective view of the sheet of FIG. 34 with a repositioning bar inserted and with a transfer hook being attached thereto.
Figure 35:
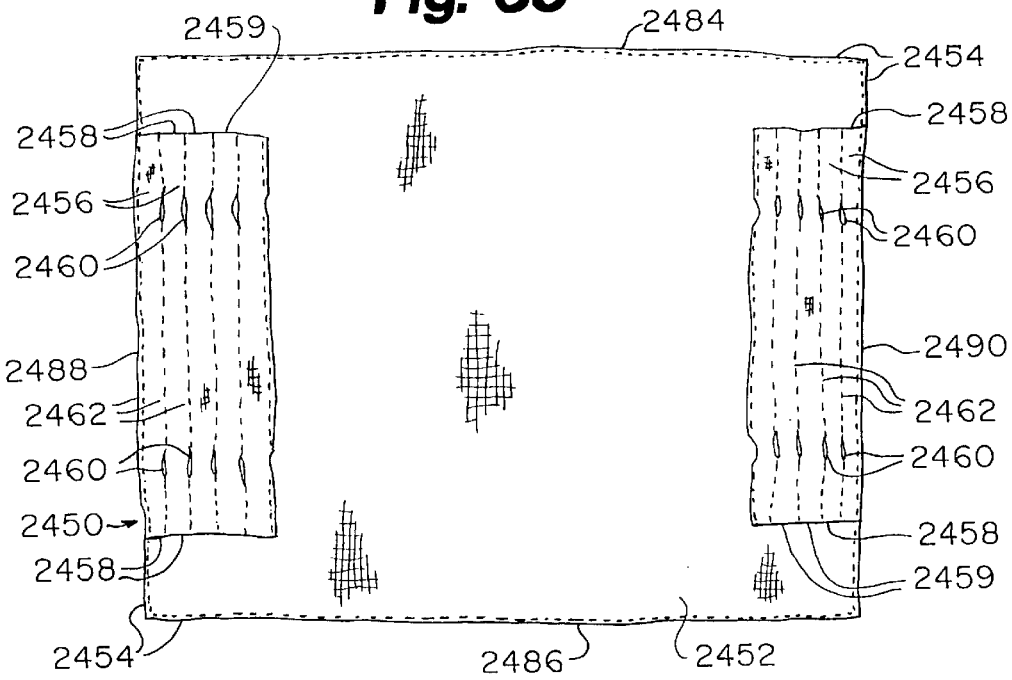
FIG. 35 is a top plan view of a second embodiment of the sheet of FIG. 34.

FIGS. 35–41 depict various embodiments of a transfer sheet that may be utilized in conjunction with the transfer device of the present invention. Transfer sheet 2450 displays respective first, second, third, and fourth edges 2484, 2486, 2488, 2490. In FIG. 34, a plurality of pockets 2459 are depicted extending generally parallel to respective first, third, and fourth edges 2484, 2488, 2490, corresponding to a patient's head and sides. FIG. 35 depicts a plurality of pockets 2459 extending generally parallel to respective third and fourth edges 2488, 2490, corresponding to portions of transfer sheet 2450 normally flanking a patient. In FIG. 36 a plurality of pockets 2459 are depicted extending generally parallel to each respective first and second edge 2484, 2486. Edges 2484, 2486, respectively, correspond to edges proximate a patient's head and foot. While pockets 2459 are depicted as generally contiguous or adjoining in FIGS. 35–39, pockets 2459 may be spaced apart as well.

Figure 40:
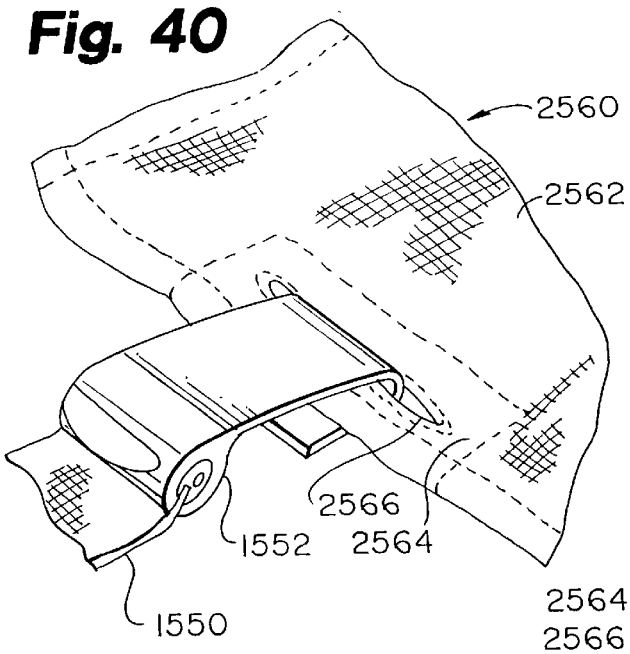
FIG. 40 is a fragmentary perspective view of an embodiment of another sheet of this invention.
Figure 41:
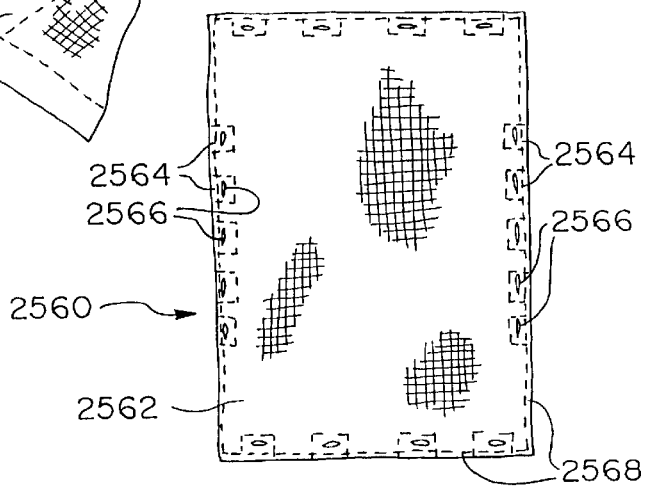
FIG. 41 is a perspective view of the sheet of FIG. 40.

In FIGS. 40–41 other embodiments of the substantially pliable underlayment of this invention are depicted. Referring to FIGS. 40, 41, the pliable underlayment of the present invention is depicted generally as transfer sheet 2560. Transfer sheet 2560 includes mantle 2562 and a plurality of reinforced portions 2564. A sheet slot 2566 is defined within each reinforced portion 2564 in this embodiment. Adjacent reinforced portions 2564 cooperate to form reinforced edges 2568. In this embodiment slots 2566 are configured to accommodate a grasping or connecting member such as transfer hook 1552. In this invention, any of slots 2506, 2526, 2566, aperture 2546 or any opening formed in a pliable underlayment such as any of the transfer sheets described above, may be bordered by such protective and reinforcing means such as grommets.

In operation, referring particularly to FIGS. 1 and 2, portable patient transfer device 30 may be hand carried to the desired location of use by grasping handle 34. The portable patient transfer device may then be secured to the patient support 46 by inserting first mating number 36 and second mating number 38 into first slot 48 and second slot 50. The operator may then engage the securing devices 52, if present, to hold the portable patient transfer device 30 in place. Once secured to the patient support, the strap and hook assemblies 47 are adjoined to the transfer sheet 91. The transfer sheet 91 may be engaged with the strap and hook assemblies 47 by either placing one or more transfer clamps 81 into one bar slots 166, 168 or sheet slots 2566. The patient transfer device 30 may then be activated to complete the patient repositioning or transfer.

Referring to FIGS. 3 and 4, patient transfer device 58 may be secured to the top of headboard 60 via mating members 64 and mating ports 66. The positioning of the patient transfer device 58 on the top of the headboard 60 may optionally place the device 58 in communication with a power source operating through the patient support 46. Once secured in place the patient transfer device 58 may be used to accomplish pull-ups by engaging the transfer sheet in a similar method to that previously described.

Referring now to FIG. 5, patient transfer device 74 may be substituted for headboard 76. It is further noted that other embodiments similar to the patient transfer device 74, as disclosed in FIG. 5, may include, but are not limited to transfer devices 30 adapted and configured to releasably replace footboards or side rails. Once in place, patient transfer device 74 may be operated via control panel 82 in order to accomplish pull ups, repositioning, rollovers or patient transfers in a method similar to that previously described.

Referring to FIGS. 6–10, when operating patient transfer device 74, which includes one or more strap positioning devices 84 and pulleys 86, the strap and hook assemblies 47 are threaded through pulleys 86 located in the strap positioning device 84. Once threaded through the pulleys 86, the strap and hook assemblies 47 are engaged with the transfer sheet 91. Activation of the patient transfer device 74 then guides the straps 80 through or around the pulleys 86 thereby accomplishing the patient pull-up, reposition, rollover or transfer.

Referring to FIG. 11, this embodiment of the patient transfer device 90 further allows transportation of an entire patient support 46 with patient. In operation, the patient transfer device 90, secured under the patient support 46, activated by the operator to initiate the drive shaft 95, which drives one or more of the wheels 100 on the patient support 46. The operator may manipulate the patient transfer device 90 by using an automated control panel 102 that controls the speed and direction of the patient support 46.

Referring to FIGS. 12 and 13, this embodiment of the patient transfer device 90 includes foldable roll over members 104. When not in use, foldable roll over members 104 may be folded parallel to bed rails 106 or retracted into the storage position 108 as depicted in FIG. 13. One embodiment of the rollover members 104 may include a telescoping member (not shown), which allows for the raising and retraction of the rollover members 104. When it is desired to roll over a patient, foldable roll over members 104 may be lifted to an operating position 110. Thereupon, transfer straps 80 may be engaged with the transfer sheet 91, followed by the activation of the transfer device 90 to accomplish patient roll overs in an ergonomic fashion.

Referring to FIGS. 14–17A and B, rolling patient transfer device 112 may be transported to its location of use by pushing by an attendant if wheels 132 are free-rolling or under its own power in the case of power wheels 132. Rolling patient transfer device 112 is aligned so as to engage connectors 122 to bed frame connectors 140. Depending upon the embodiment of the invention, bed frame connectors 140 may also include electrical interface 144 to supply electrical power for the operation of motor winch assembly 40. After engagement of the connectors 122 to the bed frame connectors 144, the strap and hook assemblies 47 may be adjoined to the transfer sheet 91 for repositioning and/or transfer of the patient.

Referring to FIGS. 18A–D, rolling patient transfer device 112 may include an adjustable inner column such that the height of housing 114 may be adjusted by an attendant. In the case of the embodiment shown in FIGS. 18A–D, the handle 128 may be manipulated by a motion, such as a jack pumping motion, to activate the elevating mechanism 138 and thereby adjust the housing 114 to the appropriate height for the patient reposition or transfer.

Referring to FIGS. 19A and B, 20, and 21, rolling patient transfer device 112 may include one or more clamping members 150 that may be employed to provide additional securing features and stability to the rolling transfer device 112 while performing a patient transfer or reposition. Additionally, the clamping members 150 may also be utilized to secure a patient transfer device 112 to the patient support 46 for the transport of the entire patient support 46 with or without a patient.

Figure 21:
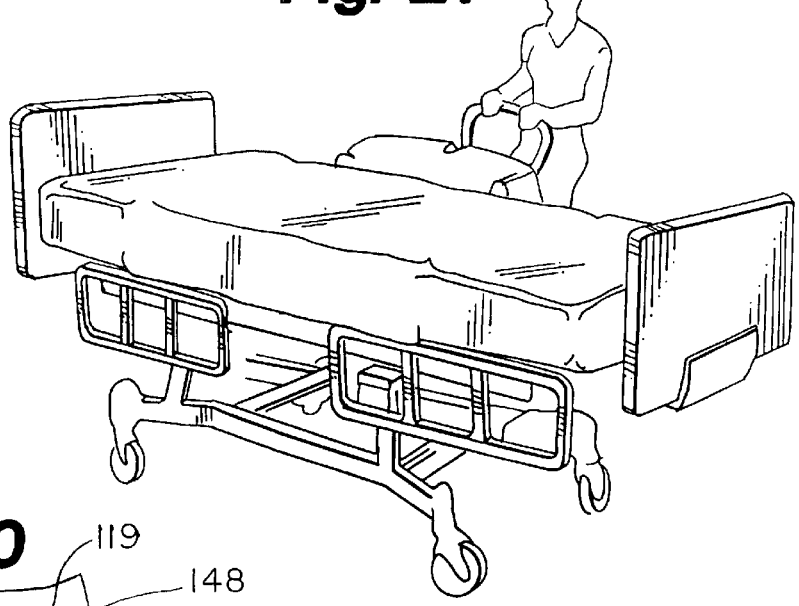
FIG. 21 is a perspective view of patient transfer device of FIGS. 19A & B and 20 in operation.
Figure 20:
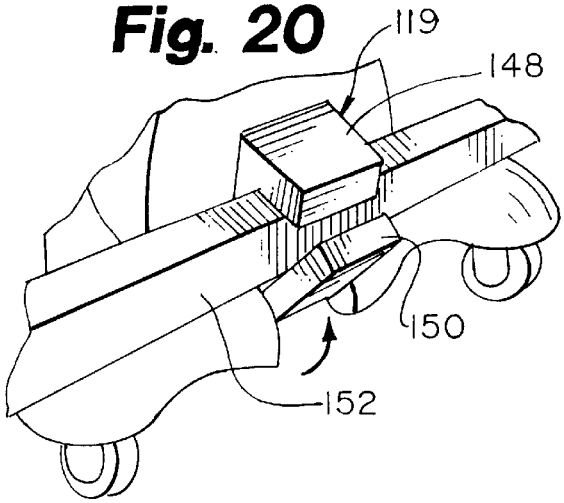
FIG. 20 is a detailed perspective view of a clamping mechanism as used with a patient transfer device of the present invention.

Referring to FIG. 19A, an operator may guide the rolling patient transfer device 112 in proximity to the patient support 46 such that clamping member 150 is proximate to patient support member 152. Upon contact with the patient support member 152 the clamping member 150 is actuated. Referring to FIGS. 19A and B, it is noted that clamping member 150 may be optionally actuated by a foot pedal 154. Actuation of the clamping member 150 closes the clamping member 150 and secures by grasping the patient support member 152 against fixed member 148. Once the rolling transfer device 112 is secured, as depicted in FIG. 21, an attendant may ergonomically perform the patient reposition/transfer or perform the movement of the entire patient support 46.

Referring to FIGS. 30 and 31A and B, in use, bed 902 and cart 904 are aligned and may be secured together. If a patient is to be transferred from bed 902 onto cart 904, clamp 914 is attached to a transfer sheet upon which the patient is disposed. The straps 918 attached to clamp 914 have been routed under bed 902 and cart 904, then upwards, and then horizontally by means of perpendicular transfer units 910 and 912. Once motor-winch unit 906 is activated, straps 918 are retracted. The transfer force exerted thereby will transport the patient in the direction of arrow 926 from bed 902 onto cart 904. Once the patient has been transferred onto cart 904, motor-winch unit 906 is disengaged. Alternatively, a sensing device (not shown) may be attached to perpendicular transfer unit 910. This sensing device may be either mechanical, electronic, magnetic, optical or a combination thereof in its operation and may detect the presence of the patient, the buckle, the strap portion proximate the buckle, or the clamp within a predetermined distance from perpendicular transfer unit 910.

If the patient is to be transferred from cart 904 onto bed 902, straps 918 are routed through perpendicular transfer unit 908 and onto mattress 915 where they are attached to clamp 914. Clamp 914 is then securely attached to a transfer sheet upon which the patient is disposed. Motor-winch unit 906 is then activated, thereby retracting strap 918 in the direction of arrow 930, thereby generating a transfer force upon clamp 914. The transfer force acts upon the transfer sheet upon which the patient is disposed, thereby transferring the patient from cart 904 onto bed 902 and thereby further, or additionally, gripping the transfer sheet secured within clamp 914. Again, patient proximity sensing devices may be included in perpendicular transfer unit 908 as discussed hereinabove. Perpendicular transfer units 908, 910, and 912 may include either a pulley system or a roller system onto which straps 918 are emplaced prior to a patient transfer. Clamp 914 may be any of the clamps disclosed herein. Some exemplary embodiments of motor-winch unit 906 are discussed in more detail herein.

The present invention may be embodied in other specific forms without departing from the spirit of the essential attributes thereof; therefore, the illustrated embodiments should be considered in all respects as illustrative and not restrictive, reference being made to the appended claims rather than to the foregoing description to indicate the scope of the invention.

What is claimed is:

1. A patient support apparatus comprising a frame, a mattress supported on the frame, a headboard coupled to the frame adjacent a head end of the mattress, a motor winch assembly coupled to the frame, a connector adapted for releasable attachment to a sheet supported on the mattress, and at least one flexible pulling member extending between the motor winch assembly and the connector, the motor winch assembly being operable to wind up the flexible pulling member to pull the connector toward the headboard, the at least one flexible pulling member having a first portion extending at a nonhorizontal and nonvertical inclination between the connector and the headboard.

2. The patient support apparatus of claim 1, further comprising at least one pulley that alters a direction of pull of the at least one flexible pulling member.

3. The patient support apparatus of claim 2, wherein the at least one pulley is coupled to the headboard.

4. The patient support apparatus of claim 3, wherein the mattress has an upper surface on which a patient may rest and the pulley is coupled to the headboard above the upper surface.

5. The patient support apparatus of claim 1, wherein the mattress has an upper surface on which a patient may rest and the motor winch assembly has a motor that is situated below the upper surface.

6. The patient support apparatus of claim 1, further comprising a housing in which the motor winch assembly is at least partially disposed.

7. The patient support apparatus of claim 6, wherein the mattress has an upper surface on which a patient may rest and at least a portion of the housing is situated below the upper surface.

8. The patient support apparatus of claim 7, wherein the entire housing is situated below the upper surface.

9. The patient support apparatus of claim 1, wherein the at least one flexible pulling member comprises one of a belt, a strap, a cable, a webbing, and a cord.

10. The patient support apparatus of claim 1, wherein the motor winch assembly is powered by a power supply that is operably connected to the patient support apparatus.

11. The patient support apparatus of claim 1, wherein a second portion of the flexible pulling member extends vertically adjacent a vertical surface of the headboard.

12. The patient support apparatus of claim 1, wherein the mattress has an upper surface on which a patient may rest, the at least one flexible member winds up below the upper surface in response to operation of the motor winch assembly, and the connector moves along the upper surface toward the headboard in response to operation of the motor winch assembly.

13. The patient support apparatus of claim 1, wherein the connector comprises an elongated element adapted to be surrounded by a portion of the sheet.

14. The patient support apparatus of claim 1, wherein the motor winch assembly comprises a motor, a reduction drive operably coupled to the motor, and a drum operably coupled to the reduction drive, the drum is operably coupled to the reduction drive, and the drum windably receives the at least one flexible member.

15. The patient support apparatus of claim 14, wherein the motor is one of an electric motor, a hydraulic motor, and a pneumatic motor.

16. The patient support apparatus of claim 14, wherein the mattress has an upper surface on which a patient may rest and each of the motor, the reduction drive, and the drum are situated below the upper surface.

17. The patient support apparatus of claim 1, wherein the frame has an upper portion and a lower portion, the upper portion carries the mattress, the lower portion has floor-engaging wheels coupled thereto, and the motor winch assembly is coupled to the upper portion of the frame.

18. The patient support apparatus of claim 1, wherein the frame has an upper portion and a lower portion, the upper portion carries the mattress, the lower portion has floor-engaging wheels coupled thereto, and the motor winch assembly is coupled to the lower portion of the frame.

19. A patient support apparatus comprising a frame, a mattress supported on the frame, a headboard coupled to the frame, a motor winch assembly, a connector adapted for releasable attachment to a sheet supported on the mattress, and at least one flexible pulling member engaging a portion of the headboard and extending between the motor winch assembly and the connector along a path that extends up and over the portion of the headboard engaged by the at least one flexible pulling member, the motor winch assembly being operable to wind up the at least one flexible pulling member to pull the connector toward the headboard.

20. The patient support apparatus of claim 19, wherein the portion of the headboard engaged by the at least one flexible pulling member comprises a pulley.

21. The patient support apparatus of claim 20, wherein a first portion of the at least one flexible pulling member extends from the pulley toward the connector in a nonhorizontal and nonvertical inclination and a second portion of the at least one flexible pulling member extends substantially vertically downwardly from the pulley.

22. The patient support apparatus of claim 20, wherein the mattress has an upper surface on which a patient may rest and the pulley is located above the upper surface.

23. The patient support apparatus of claim 19, wherein the the mattress has an upper surface on which a patient may rest and the motor winch assembly has a motor that is situated below the upper surface.

24. The patient support apparatus of claim 19, further comprising a housing in which the motor winch assembly is at least partially disposed.

25. The patient support apparatus of claim 24, wherein the mattress has an upper surface on which a patient may rest and at least a portion of the housing is situated below the upper surface.

26. The patient support apparatus of claim 25, wherein the entire housing is situated below the upper surface.

27. The patient support apparatus of claim 19, wherein the at least one flexible pulling member comprises one of a belt, a strap, a cable, a webbing, and a cord.

28. The patient support apparatus of claim 19, wherein the motor winch assembly is powered by a power supply that is operably connected to the patient support apparatus.

29. The patient support apparatus of claim 19, wherein a portion of the flexible pulling member extends vertically adjacent a vertical surface of the headboard.

30. The patient support apparatus of claim 19, wherein the mattress has an upper surface on which a patient may rest, the at least one flexible member winds up below the upper surface in response to operation of the motor winch assembly, and the connector moves along the upper surface toward the headboard in response to operation of the motor winch assembly.

31. The patient support apparatus of claim 19, wherein the connector comprises an elongated element adapted to be surrounded by a portion of the sheet.

32. The patient support apparatus of claim 19, wherein the motor winch assembly comprises a motor, a reduction drive operably coupled to the motor, and a drum operably coupled to the reduction drive, the drum is operably coupled to the reduction drive, and the drum windably receives the at least one flexible pulling member.

33. The patient support apparatus of claim 32, wherein the motor is one of an electric motor, a hydraulic motor, and a pneumatic motor.

34. The patient support apparatus of claim 32, wherein the mattress has an upper surface on which a patient may rest and each of the motor, the reduction drive, and the drum are situated below the upper surface.

35. The patient support apparatus of claim 19, wherein the frame has an upper portion and a lower portion, the upper portion carries the mattress, the lower portion has floor-engaging wheels coupled thereto, and the motor winch assembly is coupled to the upper portion of the frame.

36. The patient support apparatus of claim 19, wherein the frame has an upper portion and a lower portion, the upper portion carries the mattress, the lower portion has floor-engaging wheels coupled thereto, and the motor winch assembly is coupled to the lower portion of the frame.

* * * * *